US011322874B2

(12) United States Patent
Nagae

(10) Patent No.: US 11,322,874 B2
(45) Date of Patent: May 3, 2022

(54) CONNECTOR

(71) Applicant: FUJIKURA LTD., Tokyo (JP)

(72) Inventor: Norifumi Nagae, Tokyo (JP)

(73) Assignee: FUJIKURA LTD., Tokyo (JP)

( * ) Notice: Subject to any disclaimer, the term of this patent is extended or adjusted under 35 U.S.C. 154(b) by 0 days.

(21) Appl. No.: 17/268,861

(22) PCT Filed: Apr. 22, 2019

(86) PCT No.: PCT/JP2019/017024
§ 371 (c)(1),
(2) Date: Feb. 16, 2021

(87) PCT Pub. No.: WO2020/044654
PCT Pub. Date: Mar. 5, 2020

(65) Prior Publication Data

US 2021/0175651 A1 Jun. 10, 2021

(30) Foreign Application Priority Data

Aug. 27, 2018 (JP) ..... JP2018-158085

(51) Int. Cl.
*H01R 12/79* (2011.01)
*H01R 12/88* (2011.01)
*H01R 13/20* (2006.01)

(52) U.S. Cl.
CPC ..... *H01R 12/79* (2013.01); *H01R 12/88* (2013.01); *H01R 13/20* (2013.01)

(58) Field of Classification Search
CPC ..... H01R 12/79; H01R 12/88
See application file for complete search history.

(56) References Cited

U.S. PATENT DOCUMENTS 6,089,905 A * 7/2000 Shimmyo ..... H01R 12/79 439/260
6,224,418 B1 5/2001 Miura et al.
(Continued)

FOREIGN PATENT DOCUMENTS

CN 102195160 A 9/2011
CN 107069275 A 8/2017
(Continued)

OTHER PUBLICATIONS

International Search Report and Written Opinion for related PCT App No. PCT/JP2019/017024 dated Jun. 18, 2019, 8 pgs. (partial translation).

*Primary Examiner* — Neil Abrams
(74) *Attorney, Agent, or Firm* — Procopio, Cory, Hargreaves & Savitch LLP

(57) ABSTRACT

A lock member has: a contact part that contacts one surface of an object to be connected; a locking part that has a shape allowing engagement with a part to be locked formed on the object to be connected; a connection part; and a pressure-receiving part that is pressed by a pressing member. The lock member includes at least one contact provided with a fixing function and used to enable electrification. The locking part projects in a direction that moves away from a board-mounting surface at a side near the board-mounting surface, at a position corresponding to the part to be locked of the object to be connected. The contact part is positioned on the side far from the board-mounting surface at the side facing the locking part, and at a position closer to an insertion side of the object to be connected than the locking part.

20 Claims, 15 Drawing Sheets

(56) References Cited

U.S. PATENT DOCUMENTS

| | | | | |
|---|---|---|---|---|
| 6,482,027 | B2 * | 11/2002 | Ishii | H01R 12/79 439/354 |
| 6,773,287 | B2 * | 8/2004 | Takashita | H01R 12/85 439/260 |
| 7,507,112 | B2 * | 3/2009 | Mundt | H01R 13/193 439/357 |
| 7,833,046 | B2 * | 11/2010 | Tamura | H01R 12/774 439/422 |
| 8,292,648 | B2 * | 10/2012 | Kiryu | H01R 13/6271 439/328 |
| 8,858,249 | B2 * | 10/2014 | Honda | H01R 13/648 439/260 |
| 8,939,790 | B2 * | 1/2015 | Jung | H01R 13/62 439/495 |
| 9,065,227 | B2 * | 6/2015 | Ashibu | H01R 12/79 |
| 9,276,341 | B2 * | 3/2016 | Naito | H01R 12/772 |
| 9,455,531 | B2 * | 9/2016 | Qian | H01R 13/6581 |
| 9,559,449 | B2 * | 1/2017 | Ishida | H01R 12/73 |
| 9,742,086 | B2 * | 8/2017 | Ishida | H05K 1/118 |
| 9,960,534 | B2 * | 5/2018 | Nagae | H01R 12/79 |
| 10,050,379 | B2 * | 8/2018 | Urai | H01R 12/88 |
| 10,062,990 | B1 * | 8/2018 | Hunt | H01R 12/721 |
| 11,201,425 | B2 * | 12/2021 | Mizusawa | H01R 12/79 |
| 2017/0229809 | A1 | 8/2017 | Urai et al. | |
| 2021/0175651 | A1 * | 6/2021 | Nagae | H01R 12/88 |

FOREIGN PATENT DOCUMENTS

| | | | |
|---|---|---|---|
| CN | 107546510 | A | 1/2018 |
| JP | 2004221067 | A | 8/2004 |
| JP | 2006210050 | A | 8/2006 |
| JP | 2006210051 | A | 8/2006 |
| JP | 2010212265 | A | 9/2010 |
| JP | 2011023236 | A | 2/2011 |
| JP | 2016091804 | A | 5/2016 |
| JP | 2017-059352 | A | 3/2017 |
| JP | 2017143000 | A | 8/2017 |

* cited by examiner

CONNECTOR

CROSS-REFERENCE TO RELATED APPLICATIONS

This application is a U.S. National Stage entry of PCT Application No: PCT/JP2019/017024 filed Apr. 22, 2019, which claims priority to Japanese Patent Application No. 2018-158085 filed Aug. 27, 2018, the contents of which are incorporated herein by reference.

TECHNICAL FIELD

The present invention relates to a connector usable in electronic equipment, such as a mobile phone, a laptop computer, and a digital camera. In particular, the present invention relates to a connector connectable to a connection target, such as a flexible printed circuit board and a flexible flat cable.

BACKGROUND ART

Connectors have been known which are configured to connect with a connection target through removable insertion of the connection target therein. This type of connector includes a housing, a plurality of terminals (contacts) held in the housing while being arranged alternately side-by-side in an array, lock members provided at both ends of the array of the contacts and configured to engage with the connection target to increase a holding force, and a pressure application member (pressing member) pivotably supported on the housing (see, for example, Patent Documents 1, 3, and 4). Further, Patent Document 2 is listed herein as a document disclosing a technique according to which a power source contact is integrated with a lock member.

Patent Document 1: Japanese Unexamined Patent Application, Publication No. 2004-221067

Patent Document 2: Japanese Unexamined Patent Application,

Patent Document 3: Japanese Unexamined Patent Application, Publication No. 2010-212265

Patent Document 4: Japanese Unexamined Patent Application, Publication No. 2011-023236

DISCLOSURE OF THE INVENTION

Problems to be Solved by the Invention

In general, according to the known art, such as the connectors disclosed in Patent Documents 1, 3, and 4, the lock member having a means for engaging with the connection target and the contacts having a means for contacting with the connection target are formed as separate components, resulting in the array of the contacts having a large dimension in the direction in which the contacts are arranged side-by-side. It is conceivable to adopt a configuration in which a signal contact also functions as a lock member, with reference to the technique disclosed in Patent Document 2 according to which the power source contact also functions as the lock member. In this case, the multi-functional signal contact has a contact portion to be in contact with the connection target and a lock portion having a locking function such that the contact portion is located closer than the lock portion to the pressure application member (pressing member). Accordingly, it is necessary to arrange a pattern on an intermediate layer using a via hole. As a result, the pattern arrangement of the connection target is restricted and complex.

It is an object of the present invention to provide a connector which exerts an increased holding force on a connection target, enables more contacts to be arranged side-by-side in an array while reducing a dimension of the array in a direction in which the contacts are arranged (while narrowing pitches), and allows facilitation of pattern formation of the connection target.

Means for Solving the Problems

To achieve the above object, the present invention has the following main aspect.

A first aspect is directed to a connector for connection with a connection target through removable insertion of the connection target therein, the connector being mountable on a circuit board. The connector includes: a housing having an insertion opening through which the connection target is inserted to become substantially parallel to a mounting surface of the circuit board in an inserted state; a predetermined number of contacts (C) held in the housing while being arranged side-by-side in an array, the contact (C) having a contact portion configured to contact with the connection target and a connecting portion configured to be mounted on the circuit board; a lock member held in the housing and configured to engage with the connection target; and a pressing member provided on a side of the housing opposite to the insertion opening, and having a portion shaped to be capable of pressing at least the lock member. The lock member has a contact portion (LC1) which is configured to contact with one of two opposite surfaces of the connection target, a locking portion (LC2) which has a shape engageable with a lock-mating portion formed on the connection target inserted in a proper insertion position with respect to the connector, a connecting portion (LC4) which is located closer than the locking portion (LC2) to a side with the insertion opening or the side opposite to the insertion opening, and is configured to be mounted on the circuit board, and a pressure receiving portion (LC3) which extends from the contact portion (LC1) toward the side opposite to the insertion opening and is configured to be pressed by the pressing member. The contact portion (LC1), the locking portion (LC2), the connecting portion (LC4), and the pressure receiving portion (LC3) are made of an identical metal material and integrated with one another. The connector includes at least one locking contact (LC) as the lock member usable in a conductive manner. The locking portion (LC2) corresponds in position to the lock-mating portion of the connection target, is located on a side close to the mounting surface of the circuit board, and protrudes in a direction away from the mounting surface of the circuit board. The contact portion (LC1) is provided on a side facing the locking portion (LC2) and being distant from the mounting surface of the circuit board, and is located closer than the locking portion (LC2) to the side where the connection target is inserted.

A second aspect is an embodiment of the first aspect. In the second aspect, the locking contact (LC) further has a coupling portion (LC5) located between the contact portion (LC1) and the connecting portion (LC4), and a contact beam having the contact portion (LC1), a coupling post having the coupling portion (LC5), and a connecting beam having the connecting portion (LC4) are arranged in a substantial crank shape or a substantial U-shape.

A third aspect is an embodiment of the first or second aspect. In the third aspect, the contacts (C) include a first contact (NSC1) having: a first contact portion (NSC1-1) which is configured to contact with at least one of the two opposite surfaces of the connection target; a first connecting portion (NSC1-4) which is located closer than the first contact portion (NSC1-1) to the side opposite to the insertion opening, and is configured to be mounted on the circuit board; a first coupling portion (NSC1-5) which is located between the first contact portion (NSC1-1) and the first connecting portion (NSC1-4); and a first pressure receiving portion (NSC1-3) which extends from the first contact portion (NSC1-1) toward the side opposite to the insertion opening, and is configured to be pressed by the pressing member. A first contact beam having the first contact portion (NSC1-1), a first coupling post having the first coupling portion (NSC1-5), and a first connecting beam having the first connecting portion (NSC1-4) are arranged in a substantial crank shape.

A fourth aspect is an embodiment of the first or second aspect. In the fourth aspect, the contacts (C) include a second contact (NSC2) having: a second contact portion (NSC2-1) which is configured to contact with at least one of the two opposite surfaces of the connection target; a second connecting portion (NSC2-4) which is located closer than the second contact portion (NSC2-1) to the side with the insertion opening, and is configured to be mounted on the circuit board; a second coupling portion (NSC2-5) which is located between the second contact portion (NSC2-1) and the second connecting portion (NSC2-4); and a second pressure receiving portion (NSC2-3) which extends from the second contact portion (NSC2-1) toward a side opposite to the insertion opening, and is configured to be pressed by the pressing member. A second contact beam having the second contact portion (NSC2-1), a second coupling post having the second coupling portion (NSC2-5), and a second connecting beam having the second connecting portion (NSC2-4) are arranged in a substantial U-shape.

A fifth aspect is an embodiment of the first or second aspect. In the fifth aspect, the contacts (C) include a third contact (NSC3) having: a third contact portion (NSC3-1) which is configured to contact with at least one of the two opposite surfaces of the connection target; a third connecting portion (NSC3-4) which is located closer than the third contact portion (NSC3-1) to the side opposite to the insertion opening, and is configured to be mounted on the circuit board; and a third coupling portion (NSC3-5) which is located between the third contact portion (NSC3-1) and the third connecting portion (NSC3-4). A third contact beam having the third contact portion (NSC3-1), a third coupling post having the third coupling portion (NSC3-5), and a third connecting beam having the third connecting portion (NSC3-4) are arranged in a substantial crank shape.

A sixth aspect is an embodiment of the first or second aspect. In the sixth aspect, the contacts (C) include a fourth contact (NSC4) having: a fourth contact portion (NSC4-1) which is configured to contact with at least one of the two opposite surfaces of the connection target; a fourth connecting portion (NSC4-4) which is located closer than the fourth contact portion (NSC4-1) to the side with the insertion opening, and is configured to be mounted on the circuit board; and a fourth coupling portion (NSC4-5) which is located between the fourth contact portion (NSC4-1) and the fourth connecting portion (NSC4-4). A fourth contact beam having the fourth contact portion (NSC4-1), a fourth coupling post having the fourth coupling portion (NSC4-5), and a fourth connecting beam having the fourth connecting portion (NSC4-4) are arranged in a substantial U-shape.

A seventh aspect is an embodiment of any one of the first to sixth aspects. In the seventh aspect, the pressing member is pivotable between a first pressing member position for applying pressure to press at least one of the pressure receiving portion, the first pressure receiving portion, and the second pressure receiving portion, and a second pressing member position for releasing the at least one of the pressure receiving portion, the first pressure receiving portion, and the second pressure receiving portion from the pressure. The pressing member has a pressure applying portion which extends in an array direction in which the contacts (C) to be pressed are arranged side-by-side; a counter wall which faces the pressure applying portion and extends in the array direction; connecting walls which connect the pressure applying portion and the counter wall to each other, and which are arranged with intervals interposed therebetween in the array direction; and through holes which are defined by the pressure applying portion, the counter wall, and the connecting walls. In the first pressing member position, the pressing member moves, by means of the pressure applying portion extending in the array direction, at least one of the pressure receiving portion, the first pressure receiving portion, and the second pressure receiving portion in a direction away from the mounting surface of the circuit board. At least in the second pressing member position, at least one of the pressure receiving portion, the first pressure receiving portion, and the second pressure receiving portion passes through the through hole.

Effects of the Invention

The present invention provides a connector which exerts an increased holding force on a connection target, enables more contacts to be arranged side-by-side in an array while reducing a dimension of the array in a direction in which the contacts are arranged (while narrowing pitches), and allows facilitation of pattern formation of the connection target.

PREFERRED MODE FOR CARRYING OUT THE INVENTION

An embodiment of a connector of the present invention will be described below with reference to the drawings. Note that the following embodiment is an example, and can be implemented in various ways within the scope of the present invention.

Figure 1A:
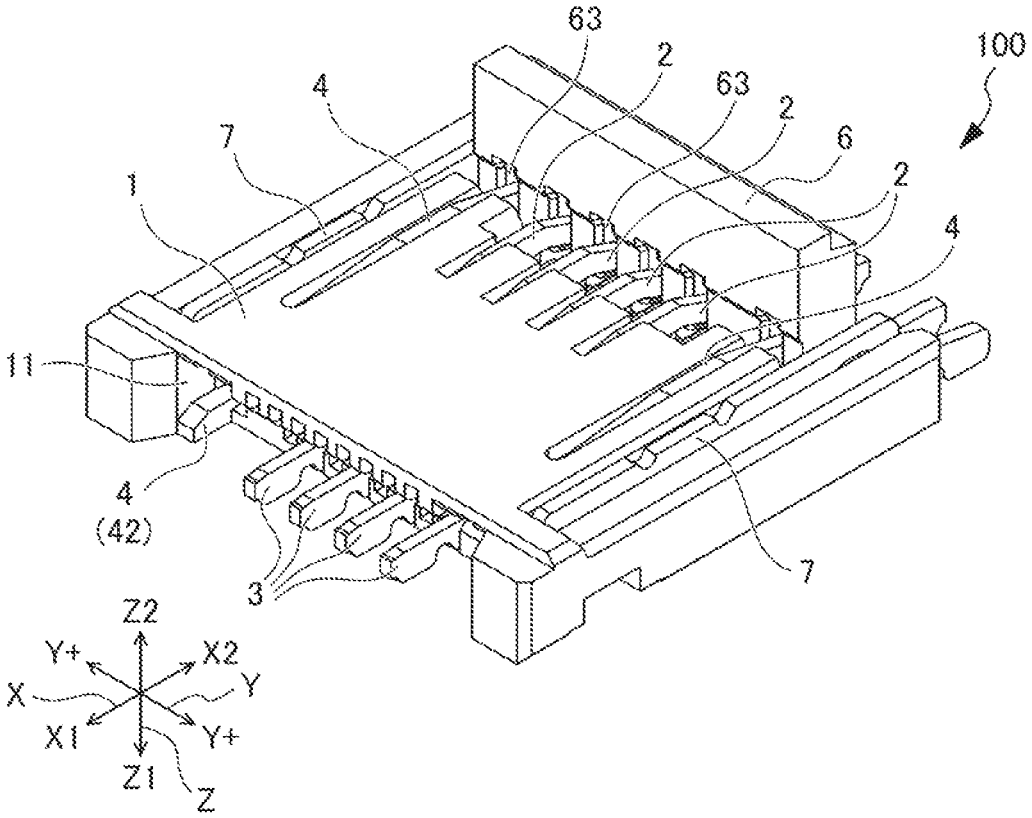
FIG. 1A is a perspective view of a connector 100 according to an embodiment of the present invention.
Figure 1B:
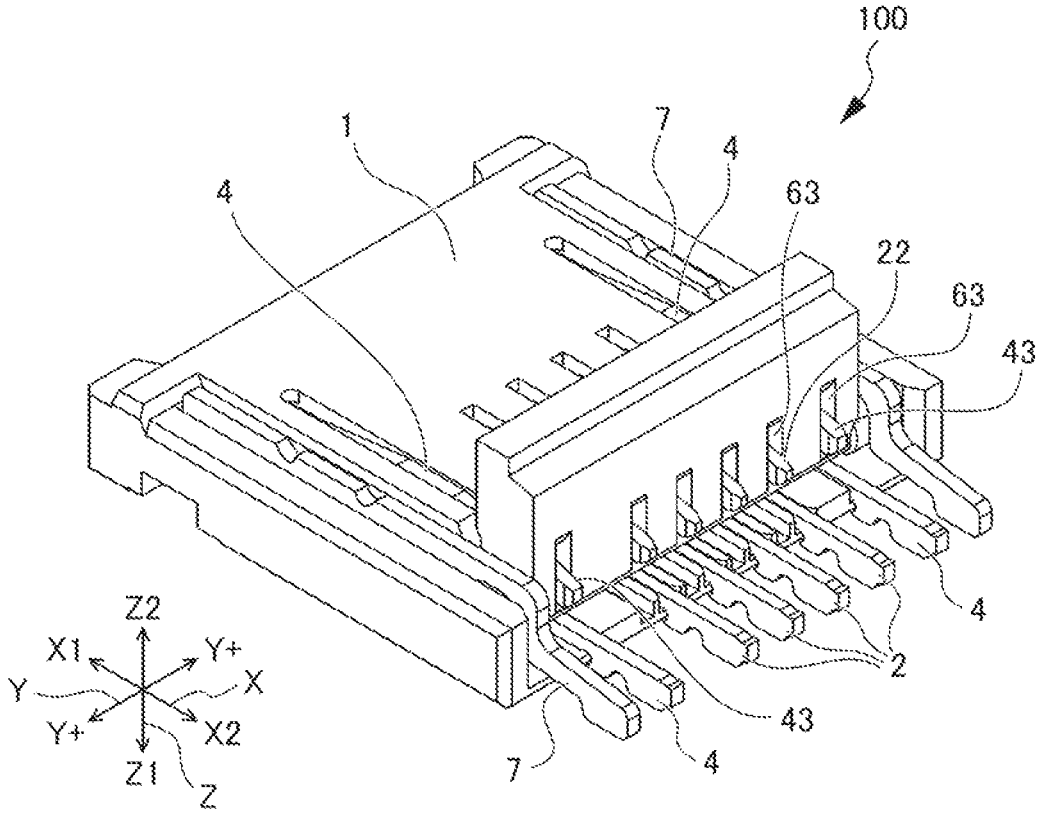
FIG. 1B is a perspective view of the connector of FIG. 1A, as viewed from a different direction.
Figure 2A:
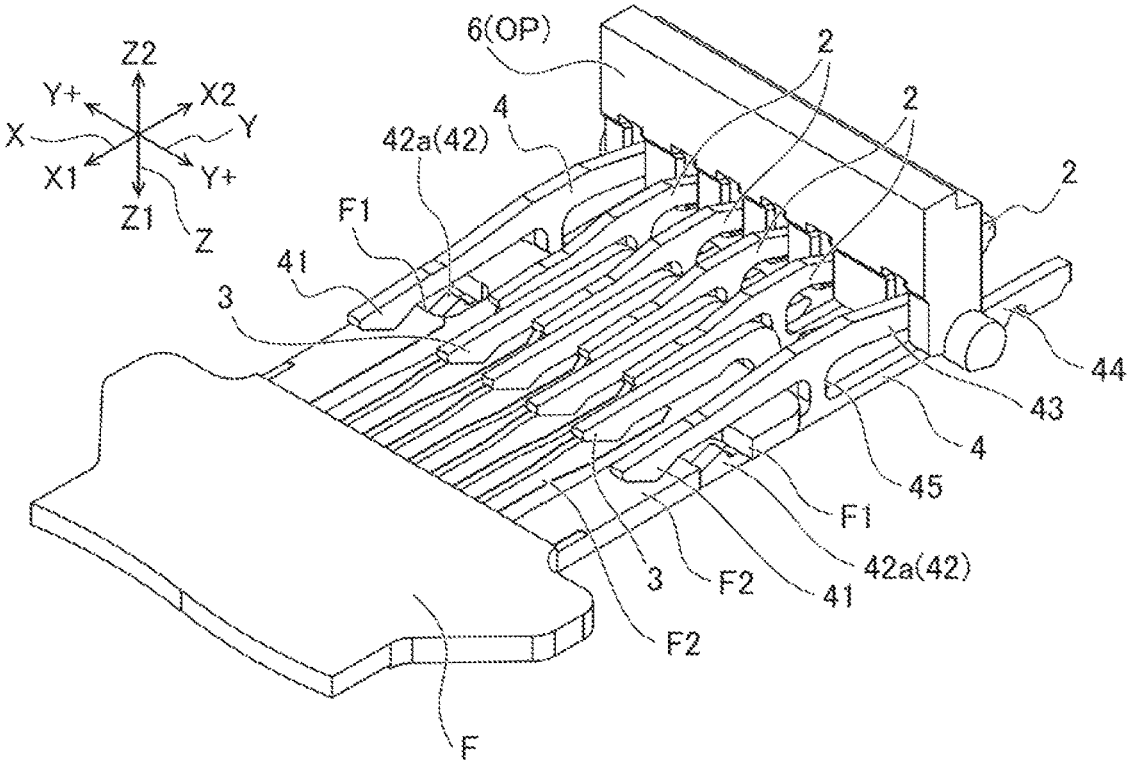
FIG. 2A is a perspective view of the connector 100 having a connection target F inserted therein, while virtually omitting a housing and other components.
Figure 2B:
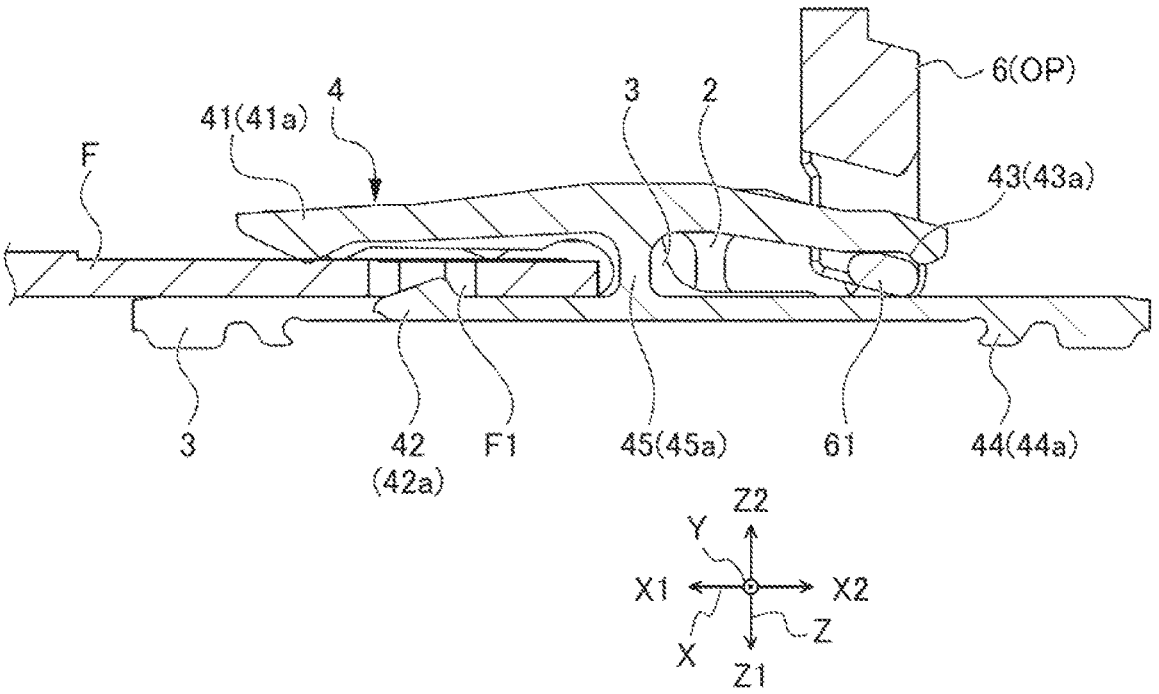
FIG. 2B is a cross-sectional view of a locking contact 4, taken along an X-Z plane in a state where the connector 100 has the connection target F inserted therein, while virtually omitting the housing and other components.
Figure 3A:
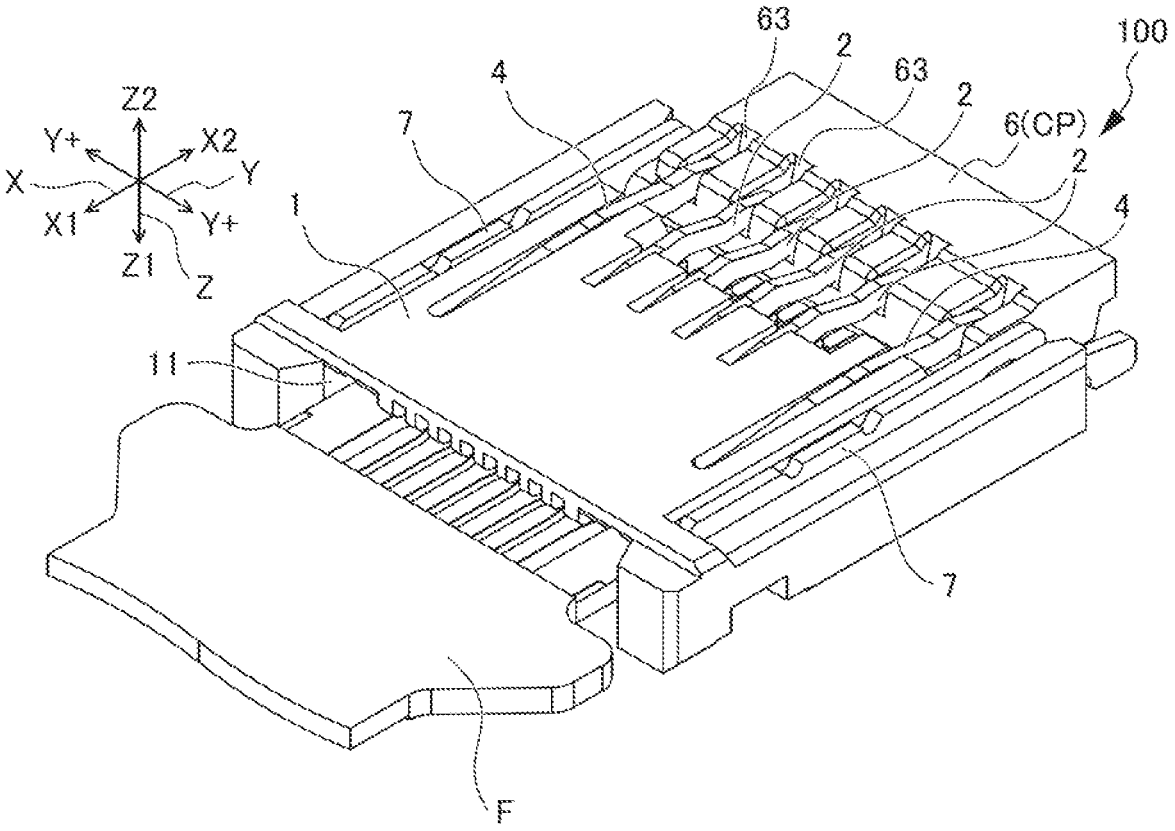
FIG. 3A is a perspective view of the connector 100 having the connection target F inserted therein and a pressing member 6 brought into a first pressing member position.
Figure 3B:
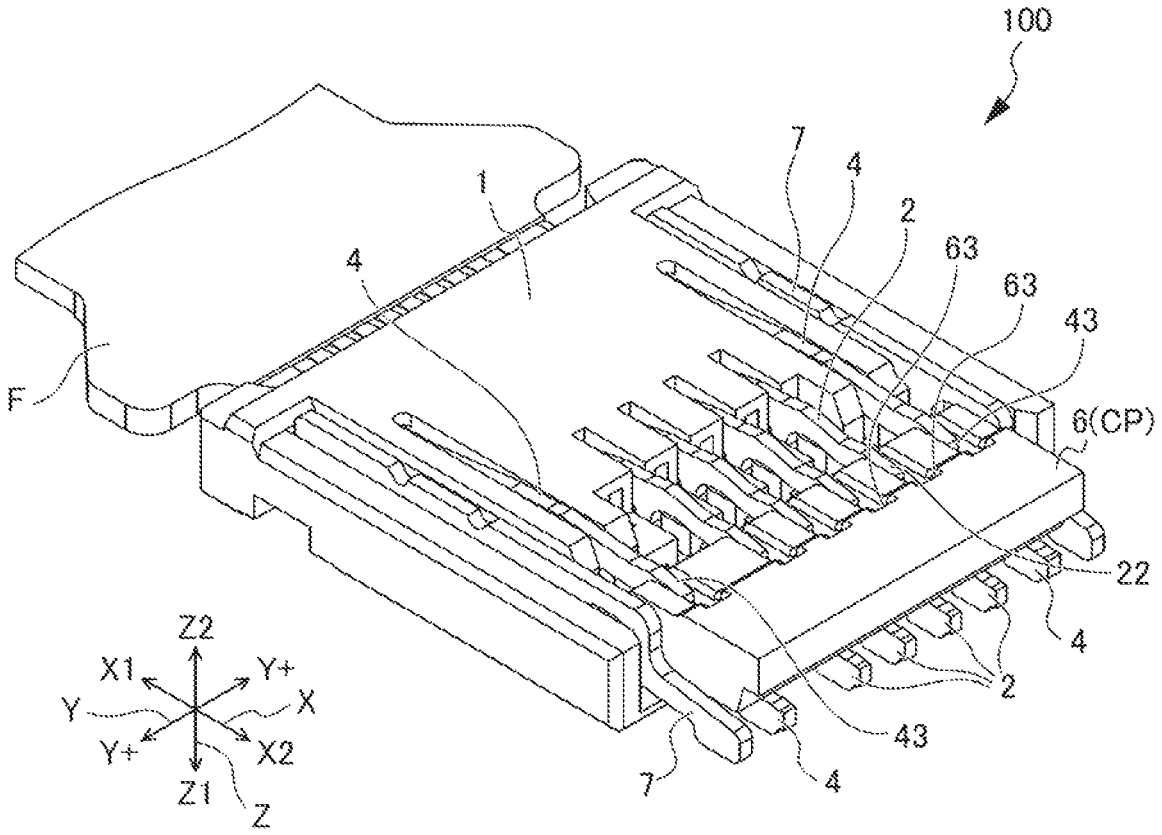
FIG. 3B is a perspective view of the connector of FIG. 3A, as viewed from a different direction.
Figure 4A:
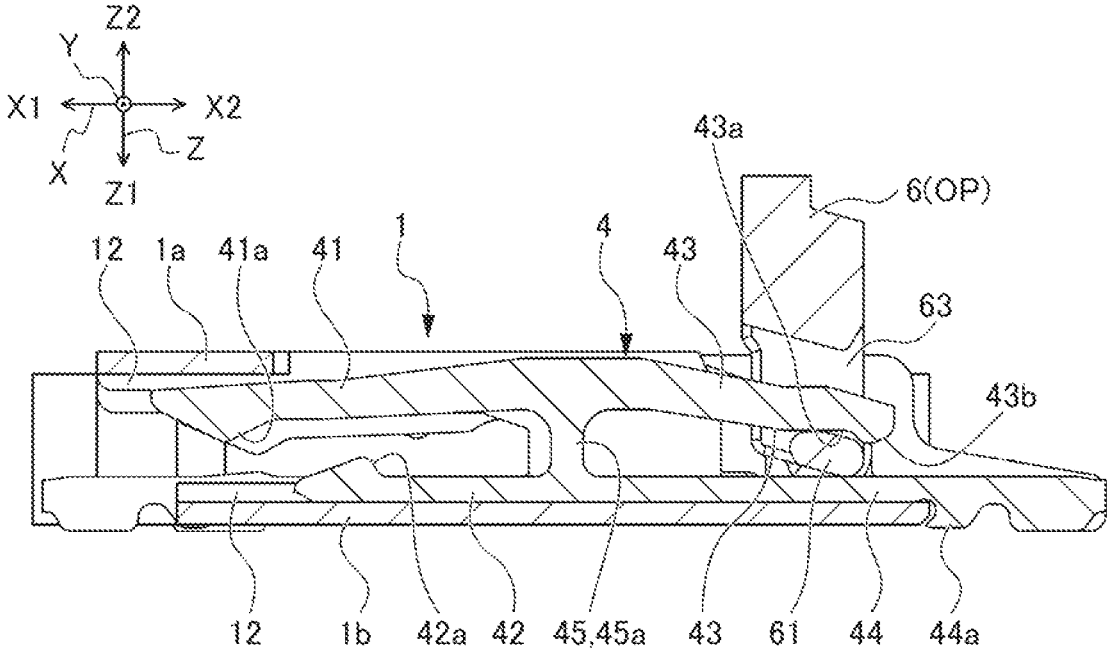
FIG. 4A is a cross-sectional view of the locking contact 4 held in the housing 1, taken along an X-Z plane when the pressing member 6 is in a second pressing member position.
Figure 4B:
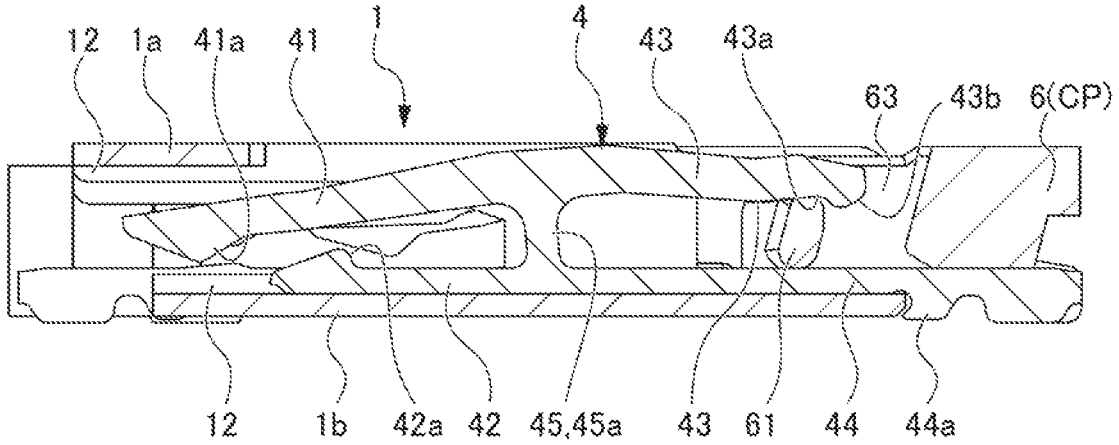
FIG. 4B is a cross-sectional view of the locking contact 4 held in the housing 1, taken along an X-Z plane when the pressing member 6 is in the first pressing member position.
Figure 5:
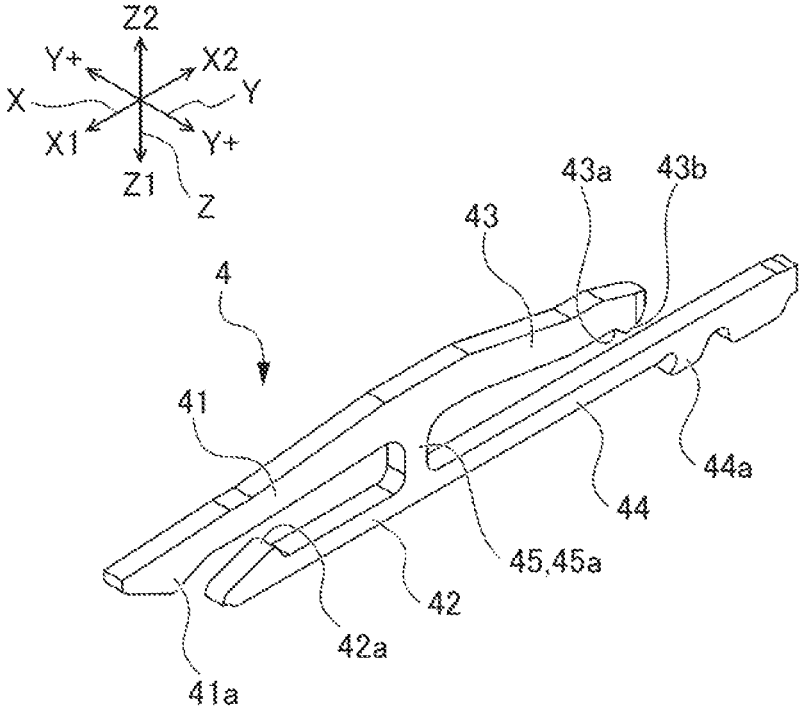
FIG. 5 is a perspective view of a locking contact 4 according to a first embodiment.

FIGS. 1A and 1B are perspective views of a connector 100 according to an embodiment of the present invention, as viewed from different directions. FIGS. 2A and 2B show the connector 100 having a connection target F inserted therein, while virtually omitting a housing and other components. FIG. 2A is a perspective view, and FIG. 2B is a cross-sectional view of a locking contact 4, taken along an X-Z plane. FIGS. 3A and 3B are perspective views of the connector 100 having the connection target F inserted therein and a pressing member 6 brought into a first pressing member position, as viewed from different directions. FIGS. 4A and 4B are cross-sectional views of the locking contact 4 held in the housing 1, taken along an X-Z plane. FIG. 4A shows a state where the pressing member 6 is in a second pressing member position, and FIG. 4B shows a state where the pressing member 6 is in the first pressing member position. FIG. 5 is a perspective view of a locking contact 4 according to a first embodiment.

Figure 6:
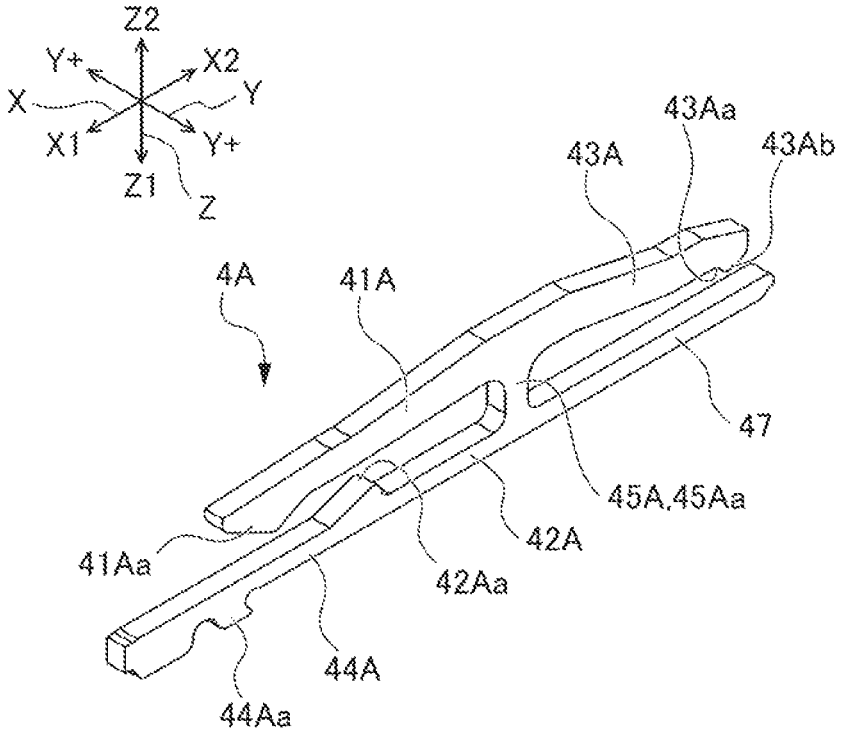
FIG. 6 is a perspective view of a locking contact 4A according to a second embodiment.
Figure 7A:
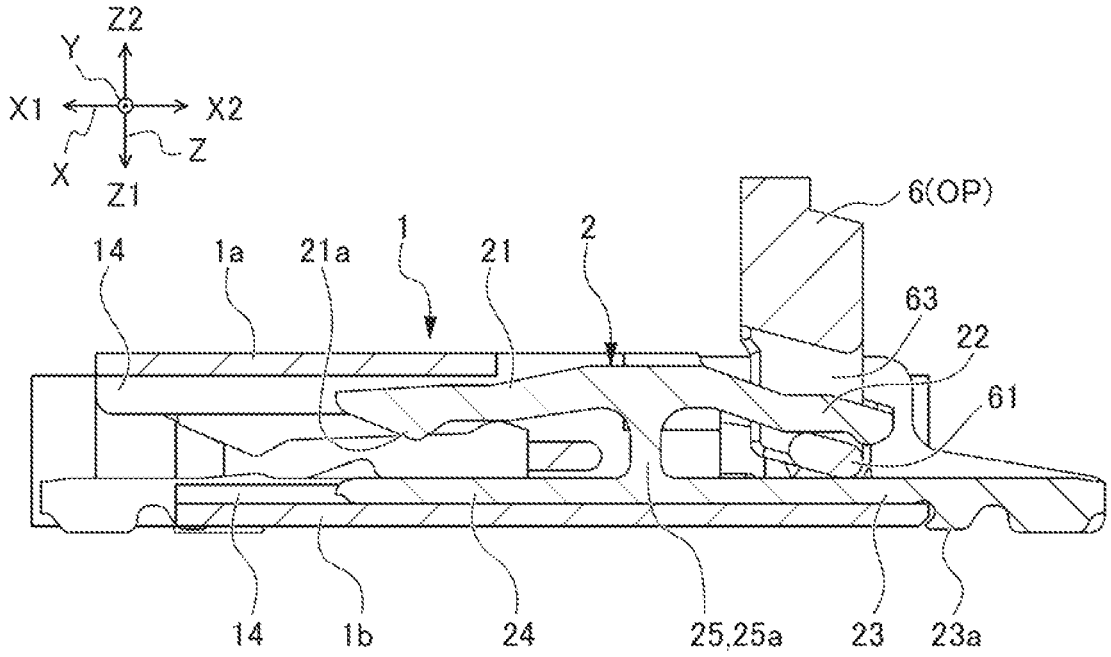
FIG. 7A is a cross-sectional view of a first signal contact 2 held in the housing 1, taken along an X-Z plane when the pressing member 6 is in the second pressing member position.
Figure 7B:
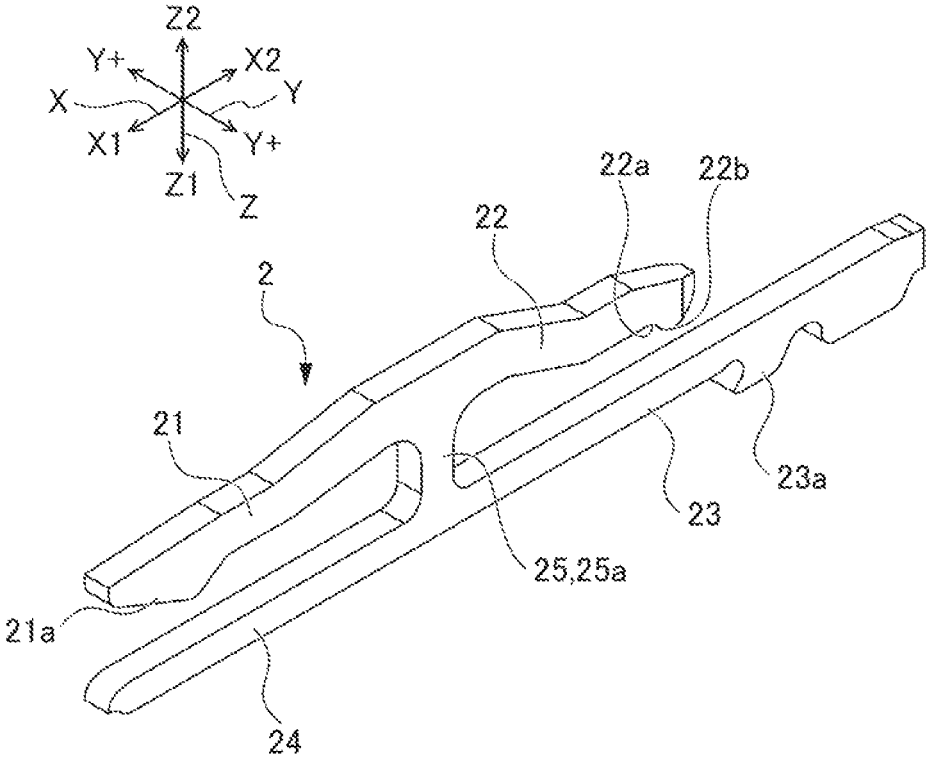
FIG. 7B is a perspective view of the first signal contact 2.
Figure 8:
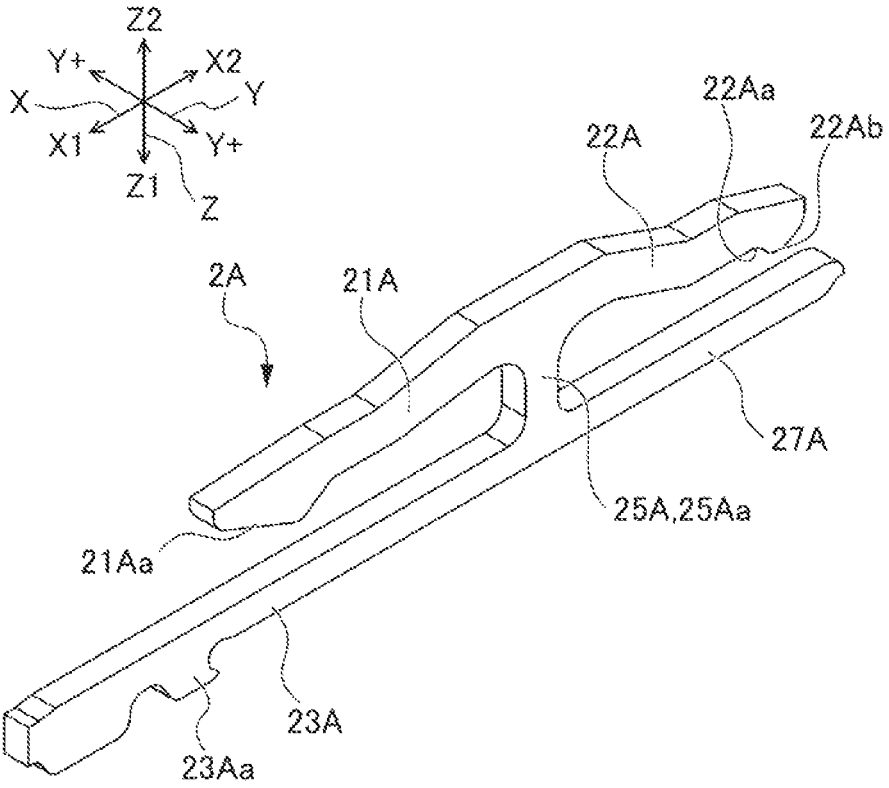
FIG. 8 is a perspective view of a second signal contact 2A.
Figure 9:
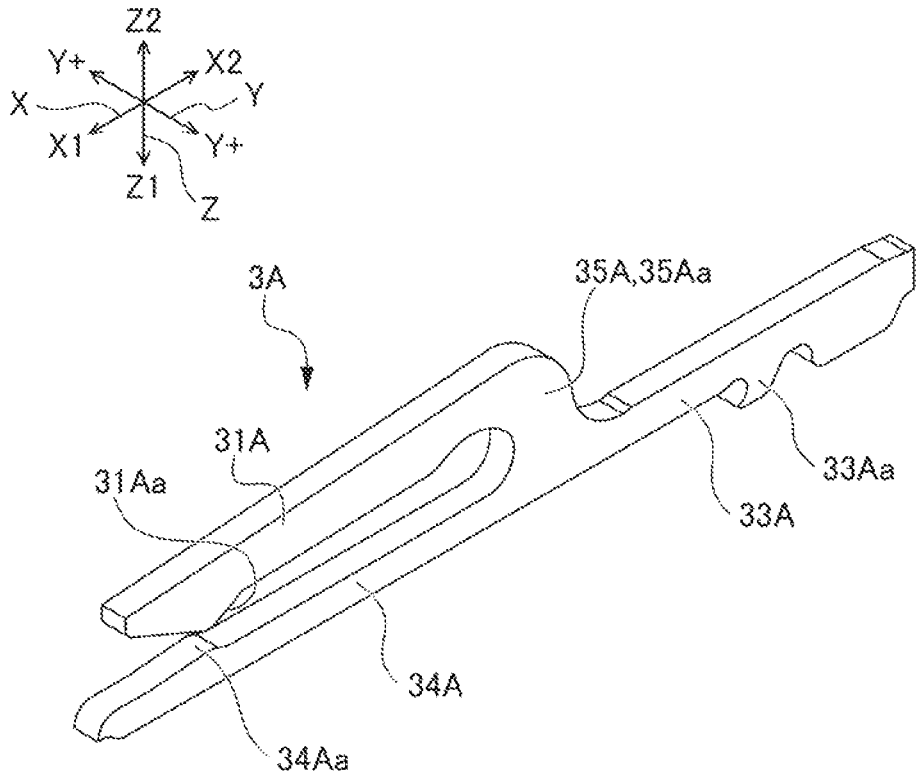
FIG. 9 is a perspective view of a third signal contact 3A.
Figure 10A:
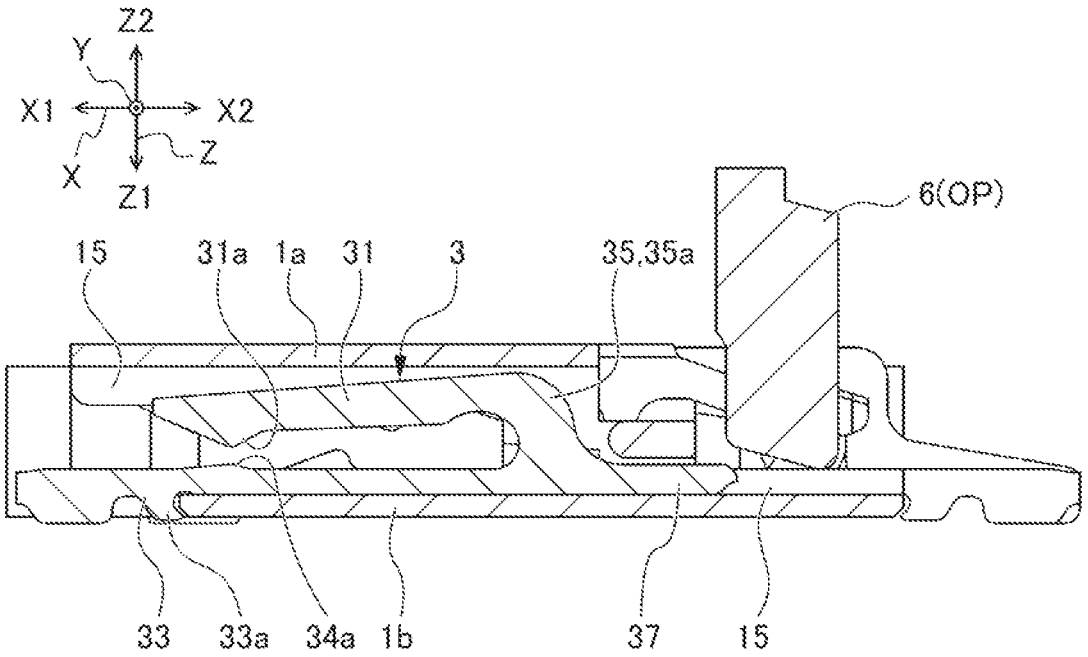
FIG. 10A is a cross-sectional view of a fourth signal contact 3 held in housing 1, taken along an X-Z plane when the pressing member 6 is in the second pressing member position.
Figure 10B:
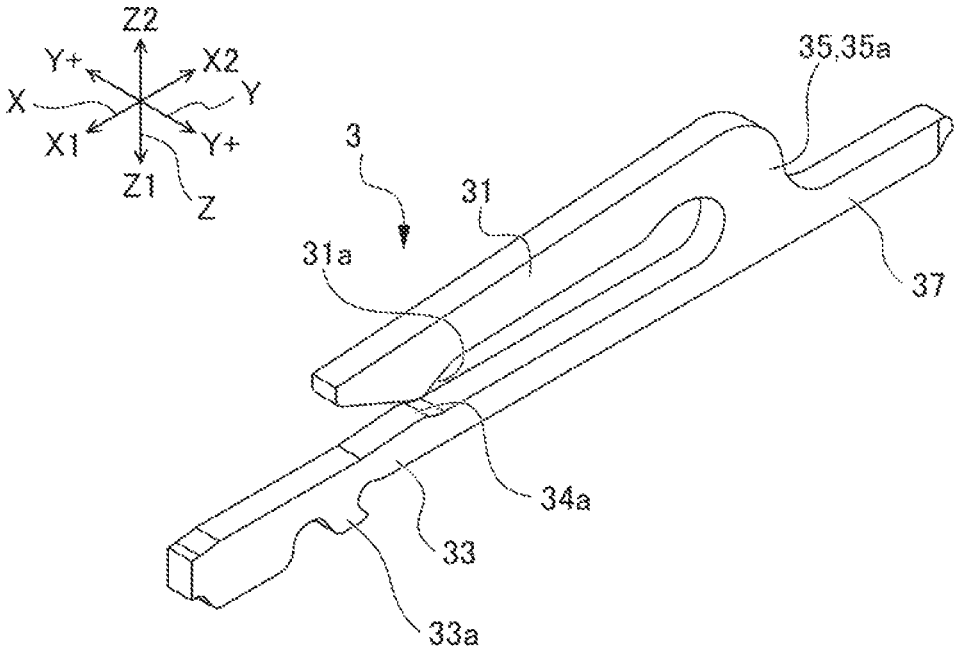
FIG. 10B is a perspective view of the fourth signal contact 3.
Figure 11A:
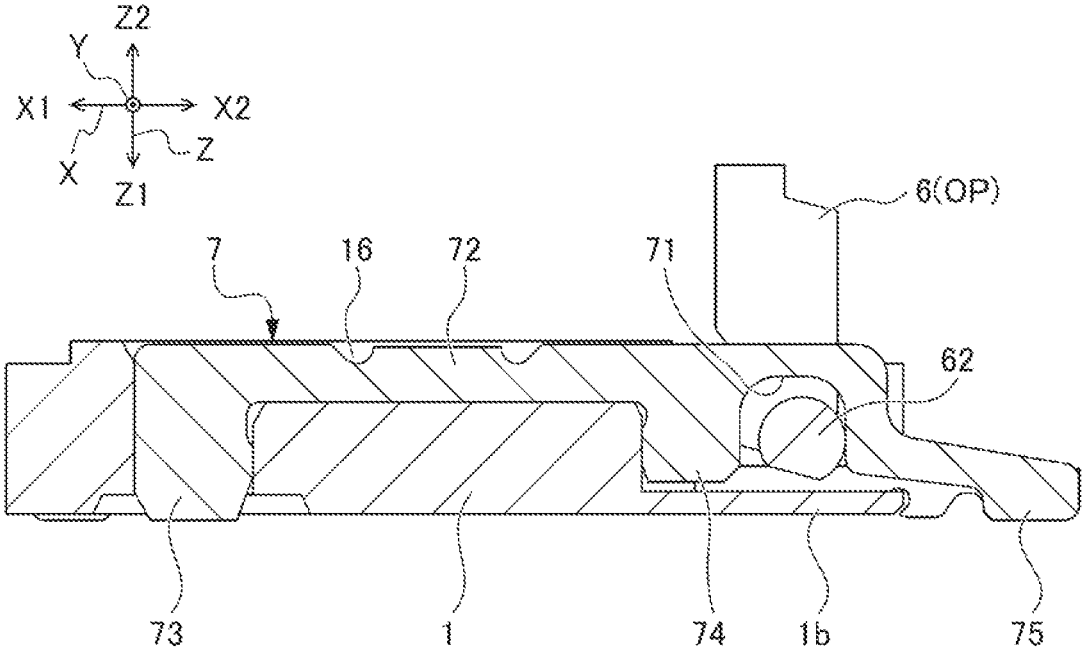
FIG. 11A is a cross-sectional view of a retaining bracket 7 held in the housing 1, taken along an X-Z plane.
Figure 11B:
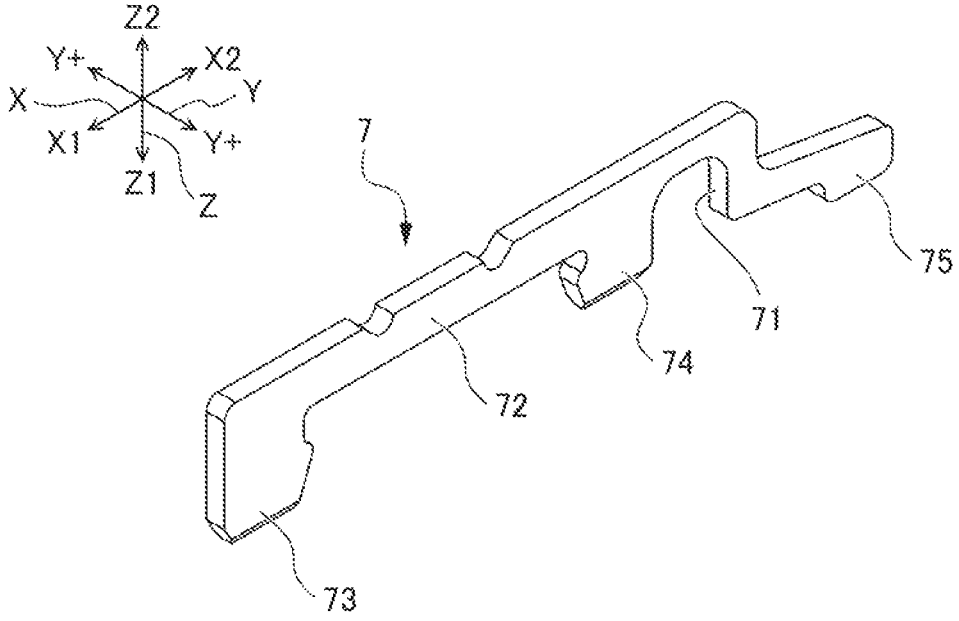
FIG. 11B is a perspective view of the retaining bracket 7.
Figure 12A:
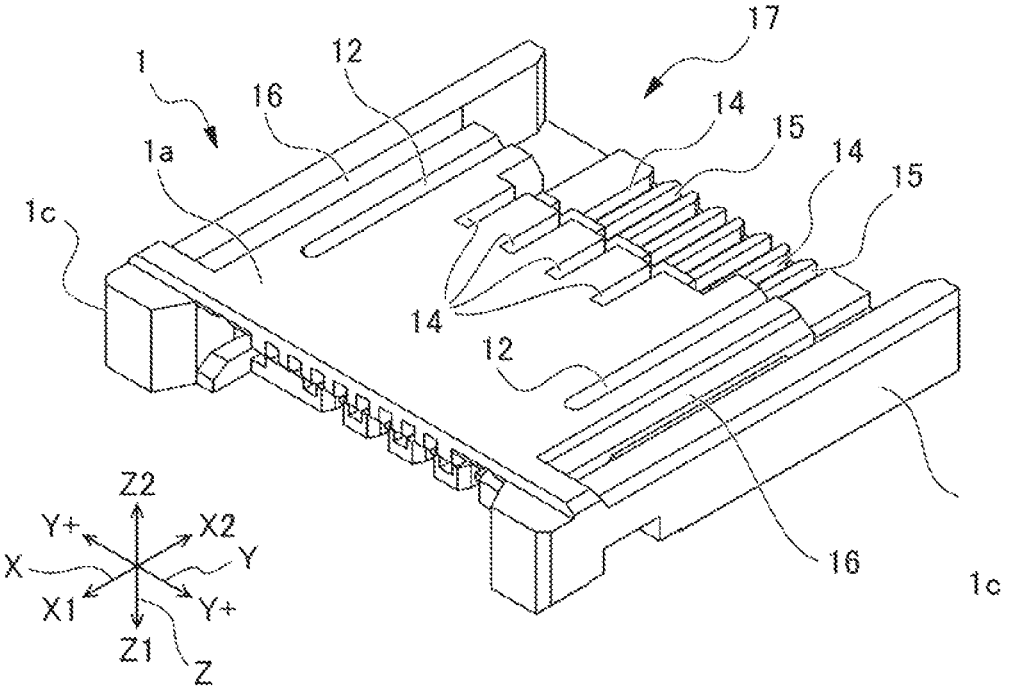
FIG. 12A is a perspective view of the housing 1.
Figure 12B:
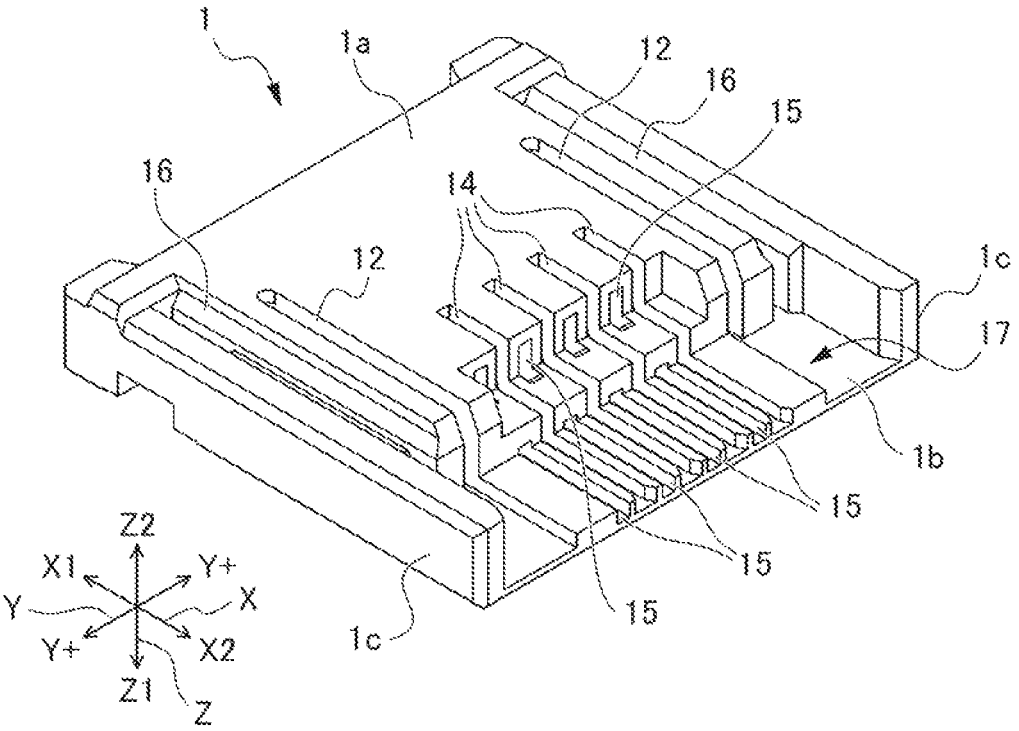
FIG. 12B is a perspective view of the housing of FIG. 12A, as viewed from a different direction.
Figure 13A:
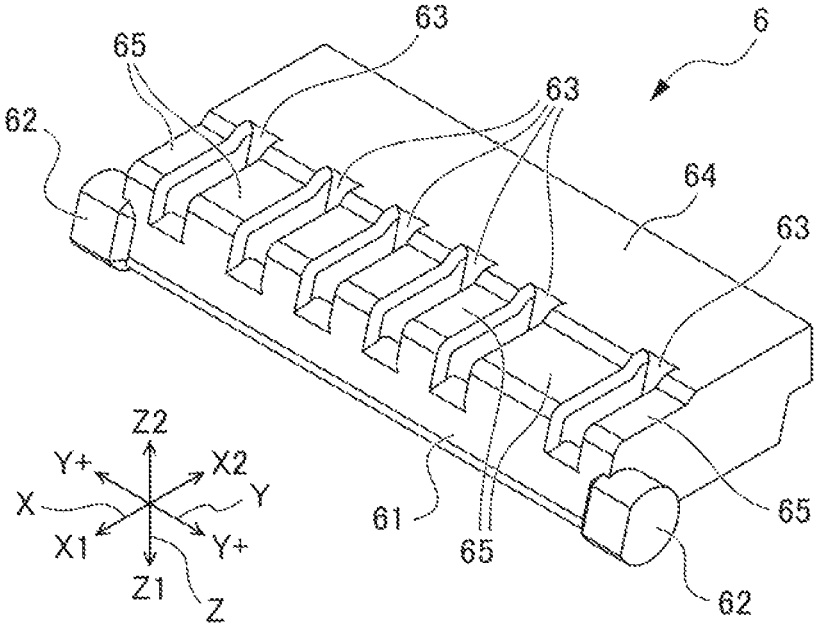
FIG. 13A is a perspective view of the pressing member 6.
Figure 13B:
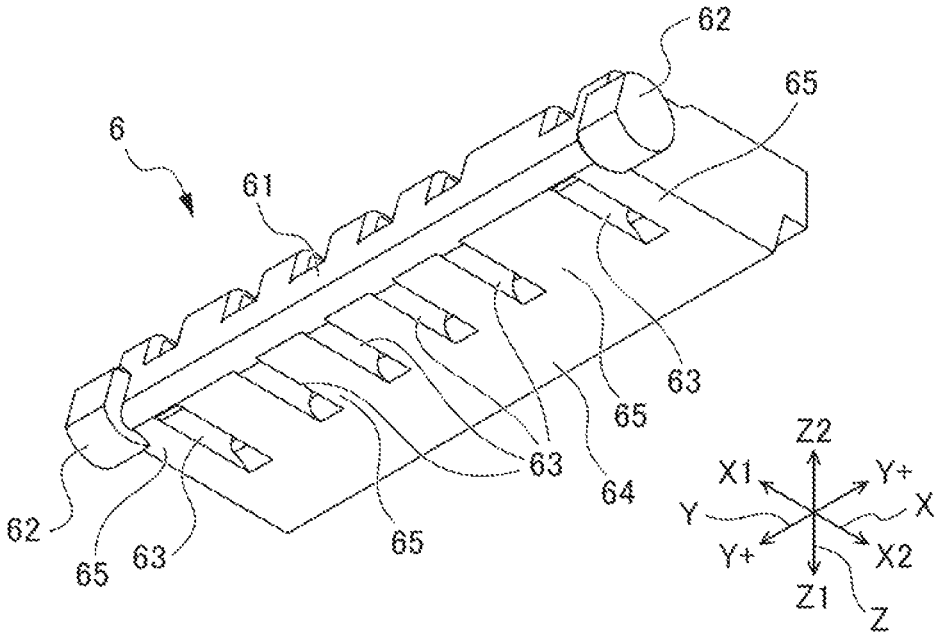
FIG. 13B is a perspective view of the pressing member of FIG. 13A, as viewed from a different direction.

FIG. 6 is a perspective view of a locking contact 4A according to a second embodiment. FIG. 7A is a cross-sectional view of a first signal contact 2 held in the housing 1, taken along an X-Z plane when the pressing member 6 is in the second pressing member position. FIG. 7B is a perspective view of the first signal contact 2. FIG. 8 is a perspective view of a second signal contact 2A. FIG. 9 is a perspective view of a third signal contact 3A. FIG. 10A is a cross-sectional view of a fourth signal contact 3 held in the housing 1, taken along an X-Z plane when the pressing member 6 is in the second pressing member position. FIG. 10B is a perspective view of the fourth signal contact 3. FIG. 11A is a cross-sectional view of a retaining bracket 7 held in the housing 1, taken along an X-Z plane. FIG. 11B is a perspective view of the retaining bracket 7. FIGS. 12A and 12B are perspective views of the housing 1, as viewed from different directions. FIGS. 13A and 13B are perspective views of the pressing member 6, as viewed from different directions.

[Configuration of Connector]

The connector 100 is mountable on a circuit board (not shown) and configured to connect with the connection target F through removable insertion of the connection target F therein. As shown in FIGS. 1A to 3B, the connector 100 includes, as main components: the housing 1 having an insertion opening 11 through which the connection target F is inserted to become substantially in parallel to a mounting surface (not shown) of the circuit board in an inserted state; a predetermined number of signal contacts (the first signal contacts 2, the fourth signal contacts 3, and the locking contacts 4) held in the housing 1 while being arranged side-by-side in an array; and the pressing member 6 provided on a side of the housing 1 opposite to the insertion opening 11, and having a portion shaped to be capable of pressing the signal contacts 2, 4. The term "substantially in parallel to" is not limited to being perfectly in parallel to the mounting surface of the circuit board (not shown), but indicates being approximately in parallel to the mounting surface. This term is intended to distinguish the present embodiment from at least an embodiment in which the connection target is inserted into the insertion opening 11 in a direction substantially perpendicular to the mounting surface of the circuit board. The term "side opposite to the insertion opening 11" refers to "side where the pressing member 6 is operated" and "side where the pressing member 6 is located (side having the pressing member 6)".

For the sake of convenience, an X-Y-Z coordinate system is defined as follows. An X direction corresponds to an insertion/removal direction of the connection target, and is substantially in parallel to the mounting surface of the circuit board. With respect to the housing 1 as a reference, an X1 side is defined as a side close to the insertion opening 11, whereas an X2 side is defined as a side opposite to the X1 side. A Y direction is an array direction (array pitch direction) in which the predetermined number of signal contacts are arranged side-by-side, and is also referred to as the lateral direction (longitudinal direction). With respect to the housing 1 as a reference, Y+ sides are each defined as an outer side in the Y direction (and are not intended to distinguish the left side and the right side from each other). A Z direction is perpendicular to the X and Y directions, and is also referred to as the height direction. With respect to the housing 1 as a reference, a Z1 side is defined as a side close to where the mounting surface of the circuit board is located, whereas a Z2 side is defined as a side distant from the mounting surface of the circuit board. The X-Y-Z coordinate system is used for convenience in describing the embodiment, and should not be strictly interpreted, unless it deviates otherwise from the spirit of the present invention.

The connection target F is connected by being removably inserted into the connector 100. Examples of the connection target F include a flexible printed circuit board (FPC), a flexible flat cable (FFC), and a flexible card. As shown in FIGS. 2A to 3B, the connection target F includes a land F2 configured to contact with at least a contact portion of each of the signal contacts 2, 3, 4, a pattern extending from the land F2 to a circuit, and lock-mating portions F1. In a state where the connection target F has been completely inserted (a proper insertion state), the lock-mating portions F1 engage with, for example, the locking contacts (LC) 4, which are provided as a pair of outermost contacts (located closest to the Y+ sides) among the signal contacts 2, 3, 4 and which sandwich therebetween the signal contacts 2, 3, in the array direction (Y direction). Thus, the lock-mating portions F1 are intended to increase a holding force exerted on the connection target F and to prevent removal of the connection target F.

The connection target F shown in FIGS. 2A to 3B has the lock-mating portions F1, which are provided close to the insertion side (the X1 side) of the insertion/removal direction (X direction) in which the connection target F is inserted into and removed from the connector 100, and which are located outward (close to the Y+ sides) in the lateral direction (Y direction) with respect to the insertion/removal direction. The lock-mating portion F1 may have any shape as long as it can engage with a locking portion (LC2) 42*a* of a locking beam (locking leg portion) 42 (to be described later) of the locking contact (LC) 4. For example, as shown in FIGS. 2A and 2B, the lock-mating portion F1 may be a cut-off portion formed in the connection target F from a lateral side. Alternatively, the lock-mating portion F1 may be a through hole or a blind hole depending on specifications.

The housing 1 has the insertion opening 11 through which the connection target F is inserted and removed, and holds the signal contacts 2, 3, 4. The housing 1 is made from an electrically insulating material (e.g., plastic). The housing 1 is formed as a one-piece component by known injection molding. Specifically, the material for the housing 1 is appropriately selected in consideration of dimensional stability, formability, costs, etc. In general, examples of the material for the housing 1 include polybutylene terephthalate (PBT), polyamide (66PA, 46PA), liquid crystal polymer (LCP), polycarbonate (PC), polyphenylene sulfide (PPS), and a synthetic material composed of two or more thereof.

The signal contacts 2, 3, 4 are held in the housing 1 while being arranged side-by-side in an array. Among them, the signal contacts 2, 4 come into stable contact with the land F2 of the connection target F when the connection target F has been completely inserted into the housing 1, and the pressing member 6 has transitioned in state, from the second pressing member position OP (see FIGS. 1A to 2B) to the first pressing member position CP (see FIGS. 3A and 3B). In a state where the connection target F has been inserted, the signal contacts 2, 4 are not in stable contact even though they contact with the land F2. The signal contacts 2, 4 come into stable contact only after the transition of the pressing member 6. The transition includes not only simple pivotal motion without movement of the pivot shaft, but also pivotal motion with movement of the pivot shaft and non-pivotal movement. Once the connection target F has been completely inserted into the housing 1, the signal contacts 3 contact with the land F2 of the connection target F to be in stable contact.

The signal contacts 2, 3, 4 are of different types, namely, a type (first signal contact 2) having a connecting portion close to the side opposite to the insertion opening 11 (close to the X2 side), shown in FIGS. 7A and 7B; a type (fourth signal contact 3) having a connecting portion close to the side with the insertion opening 11 (close to the X1 side), shown in FIGS. 10A and 10B; and the locking contact (LC) 4 also functioning as a lock member, shown in FIGS. 4A to 5.

The first signal contacts 2 and the fourth signal contacts 3 are disposed to alternate with each other in a staggered arrangement on an X-Y plane by having been inserted into the housing 1 from different directions. That is, the connecting portions of the signal contacts 2, 3 alternate with each other in a staggered arrangement. Examples of a material for the signal contacts 2, 3, 4, which are required to have spring properties and conductivity, include brass, beryllium copper, and phosphor bronze.

In the connector 100 of the embodiment shown in FIGS. 1A and 1B, the locking contacts 4, 4 are held in the housing 1 at positions close to the Y+ sides and form a pair sandwiching therebetween the signal contacts 2, 3 in the Y direction. The positions where the locking contacts 4, 4 are disposed are appropriately set in consideration of the holding force exerted on the connection target F, balance, etc. In the present embodiment, the locking contacts 4 are disposed at the two side ends of the housing 1 while forming a pair. However, the locking contact 4 may be disposed at either one of the side ends or at a central position of the housing 1, as long as a sufficient holding force and the like are obtained.

The pressing member 6 is disposed on the side opposite to the insertion opening 11 (X2 side) of the housing 1, and has a portion shaped to be capable of pressing the first signal contacts 2 and the locking contacts 4. The term "insertion opening side (side with the insertion opening 11)" refers to the side provided with the insertion opening 11 in the X direction as the insertion/removal direction of the connection target, with respect to a center of the housing 1 as a reference. The term "side opposite to the insertion opening 11" refers to the side located opposite to the "insertion opening side (side with the insertion opening 11) in the X direction as the insertion/removal direction of the connection target, with respect to the center of the housing 1 as a reference. In other words, the insertion opening side (side with the insertion opening 11) and the side opposite to the insertion opening 11 are aligned in the insertion/removal direction X of the connection target, with the center of the housing 1 interposed therebetween. Note that the pressing member 6 does not press the fourth signal contacts 3.

The pressing member 6 is made of an electrically insulating plastic material, and formed by known injection molding. Specifically, the material for the pressing member 6 is appropriately selected in consideration of dimensional stability, formability, costs, etc. In general, examples of the material for the pressing member 6 include polybutylene terephthalate (PET), polyamide (66PA, 46PA), liquid crystal polymer (LCP), polycarbonate (PC), polyphenylene sulfide (PPS), and a synthetic material composed of two or more thereof.

The connector 100 of the present embodiment further includes retaining brackets 7 to increase a mounting strength on the circuit board. The retaining brackets 7 are provided closer than the locking contacts 4 to the Y+ sides. The retaining brackets 7 are held in the housing 1, separately from the contacts. As will be detailed later, the retaining bracket 7 has a movement-restricting portion 71 where a pivot shaft (boss) 62 of the pressing member 6 is disposed while being restricted from moving, thereby restricting a range of movement of the pressing member 6, as shown in FIGS. 11A and 11B.

Next, each of the components constituting the connector 100 will be described further in detail.

Locking Contact 4 of First Embodiment

With reference to FIGS. 1A to 5, a (first) locking contact (first LC) 4 according to the first embodiment will be described further in detail.

The first locking contact 4 has both a function of establishing electrical connection with the connection target F and a function of locking the connection target F, and can be regarded as a lock member usable in a conductive manner. The first locking contacts 4 are held in the housing 1 such that the first locking contacts 4 extend in the insertion/removal direction X of the connection target F. The first locking contacts 4 are disposed as a pair of outermost contacts (closest to the Y+ sides) in the direction Y as the array direction (width direction) in which the signal contacts 2, 3, 4 are arranged side-by-side in the housing 1. The locking contacts 4 are each press-fitted in, and held by, grooves 12. The grooves 12 form part of a group of grooves which are formed on inner surfaces of the housing 1 facing each other in the Z direction as the height direction and which are partitioned by walls, and are located close to the Y+ sides (see FIGS. 12A and 123). The locking contacts 4 are disposed in the housing 1 by having been inserted from the side opposite to the insertion opening 11 (X2 side) toward the X1 side.

As shown in FIGS. 1A to 5, the first locking contact 4 has: a contact portion (LC1) 41*a* which is configured to contact with one of the two opposite surfaces of the connection target F; the locking portion (LC2) 42*a* which has a shape engageable with the lock-mating portion F1 of the connection target F in the proper insertion position with respect to the connector 100; a connecting portion (LC4) 44*a* which is located closer than the locking portion 42*a* to the side opposite to the insertion opening 11 (X2 side), and is configured to be mounted on the circuit board; a coupling portion (LC5) 45*a* which is located between the contact portion 41*a* and the connecting portion 44*a*; and a pressure receiving portion (LC3) 43*a* which extends from the contact portion (LC1) 41*a* toward the side opposite to the insertion opening 11 (X2 side), and is configured to be pressed by the pressing member 6.

More specifically, the locking portion (LC2) 42*a* corresponds in position to the lock-mating portion F1 on the connection target F in the inserted state, and has a shape protruding toward the lock-mating portion F1 in a direction toward the Z2 side. The pressure receiving portion (LC3) 43*a* is located on the side (Z2 side) facing the connecting portion (LC4) 44*a*, extends in a direction away from the contact portion 41*a* (toward the X2 side), and is configured to be pressed by the pressing member 6. The connecting portion (LC4) 44*a* extends in a direction away from the locking portion 42*a* (toward the X2 side), and is configured to be connected to the circuit board.

More specifically, the first locking contact 4 includes a contact beam (contact leg portion) 41 having the contact portion 41*a*, the locking beam (locking leg portion) 42 having the locking portion 42*a*, a pressure receiving beam (pressure receiving leg portion) 43 having the pressure receiving portion 43*a*, a connecting beam (connecting leg portion) 44 having the connecting portion 44*a*, and a coupling post (coupling leg portion) 45 having the coupling portion 45*a*, such that these beams and post are integrated with one another to form an H-shape as a whole. In particular, the contact beam 41, the coupling post 45, and the connecting beam 44 are arranged in a substantial crank shape.

The contact portion 41*a*, the locking portion 42*a*, the connecting portion 44*a*, the coupling portion 45*a*, and the pressure receiving portion 43*a* are made of the same metal material and integrated with one another. More specifically, the contact beam 41 having the contact portion 41*a*, the locking beam 42 having the locking portion 42*a*, the pressure receiving beam 43 having the pressure receiving portion 43*a*, the connecting beam 44 having the connecting portion 44*a*, and the coupling post 45 having the coupling portion 45*a* are made of the same metal material and integrated with one another.

As shown in FIGS. 2A and 28, in a state where the connection target F has been inserted between the contact beam 41 and the locking beam 42, a pressure applying portion 61 of the pressing member 6 is pivotably supported in such a manner that the pressure applying portion 61 can press the pressure receiving beam 43 having the pressure receiving portion 43*a*. In the present invention, the term "pivotal motion" includes not only simple pivotal motion without movement of the pivot shaft, but also pivotal motion with movement of the pivot shaft.

As shown in FIGS. 4A to 5, the contact beam 41 is configured to allow electrical connection by contacting with the land F2 of the connection target F. The contact beam 41 is disposed in the groove 12 on an upper wall 1*a* (close to the X2 side) of the housing 1, and is closer than the coupling post 45 to the side with the insertion opening 11 (X1 side) of housing 1. In other words, the contact beam 41 is located (close to the Z2 side) to face the locking beam 42, and extends toward the insertion opening 11 (X1 side). The contact beam 41 has an end portion close to the side with the insertion opening 11, the end portion being positioned apart from the bottom of the groove 12 close to the Z1 side, and having the contact portion 41*a* configured to contact with one of the two opposite surfaces of the connection target F (in the present embodiment, the surface close to the Z2 side). The contact portion 41*a* has a shape protruding toward the Z1 side to facilitate contact with the connection target F. In a state where the connection target F has not yet been inserted, if the pressing member 6 transitions from the second pressing member position OP to the first pressing member position CP, the contact beam 41 is displaced toward where the inserted connection target F is to be positioned. That is, the pressing member is configured to transition in this manner when the connection target F has not yet been inserted. Therefore, the contact portion 41*a* is pressed onto the connection target F when the connection target F has been inserted, thereby ensuring stable electrical contact between the contact portion 41*a* and the connection target F. The term "displaced/displacement" as used herein means that displacement takes place at least when the connection target F has not been inserted, and includes a situation in which the displacement also takes place when the connection target F has been inserted.

As shown in FIGS. 2A and 2B, the locking beam 42 is configured to engage with the lock-mating portion F1 on the connection target F to temporarily fasten the connection target F in the proper insertion position, thereby making it unlikely for the connection target F to be disadvantageously (unintentionally) removed. The locking beam 42 is disposed in the groove 12 on a lower wall 1*b* (close to Z1 side) of the housing 1 to face the contact beam 41, and is located closer than the coupling post 45 to the side with insertion opening 11 (X1 side). That is, the locking beam 42 extends toward the insertion opening 11 (in the direction to the X1 side). The locking beam 42 is held in the groove 12 such that part of the locking beam 42 is visible from the side with insertion opening 11.

The locking beam 42 has the locking portion 42*a* which corresponds in position to the lock-mating portion F1 on the connection target F inserted in the housing 1, and which protrudes toward the lock-mating portion F1. In other words, the locking portion 42*a* is provided at a position corresponding to the lock-mating portion F1 of the connection target F which has been completely inserted. The locking portion

42*a* is provided in an end portion (close to the X1 side) of the locking beam 42, and has a tapered shape the contour of which extends obliquely upward from the end portion of the locking beam 42, and then, substantially vertically to reach the locking beam 42. That is, the locking portion 42*a* of the locking beam 42 protrudes from the groove 12, in which the locking beam 42 is held and which is provided on the lower wall 1*b* (close to the Z1 side) of the housing 1, toward the upper wall 1*a* in the direction to the Z2 side.

The locking portion 42*a* and the contact portion 41*a* are in a positional relationship described as follows, the positional relationship constituting a feature of the present invention. As shown in FIGS. 4A to 5, the locking portion 42*a* corresponds in position to the lock-mating portion F1 of the connection target F, and protrudes from a side close to the mounting surface of the circuit board (close to the Z1 side) in a direction away from the mounting surface (a direction toward the Z2 side). The contact portion 41*a* is provided on the side (close to the Z2 side) which faces the locking portion 42*a* and which is distant from the mounting surface of the circuit board, and is located closer than the locking portion 42*a* to the side (X1 side) where the connection target is inserted.

The pressure receiving beam 43 is configured to be displaced in a direction away from the mounting surface of the circuit board (toward the Z2 side) by being pressed by the pressure applying portion 61 of the pressing member 6. The pressure receiving beam 43 is disposed on the upper wall 1*a* (close to the X2 side) of the housing 1 and faces the connecting beam 44. The pressure receiving beam 43 is closer than the coupling post 45 to the side opposite to the insertion opening 11 (X2 side) of the housing 1. That is, the pressure receiving beam 43 is located close to the side opposite to the insertion opening 11 (X2 side) and extends toward the side where the pressing member is provided. The pressure receiving beam 43 has the pressure receiving portion 43*a* configured to be pressed by the pressing member 6.

The pressure receiving portion 43*a* preferably has a swelling-prevention means at an end thereof. The swelling-prevention means prevents a central portion of the pressing member 6 in the array direction from swelling and moving (referred to also as "swelling movement") toward the side opposite to the insertion opening 11 (X2 side) of housing 1, due to a repulsive force caused by pressing by the pressing member 6. Specifically, the pressure receiving beam 43 has, at an end close to the X2 side, a protrusion 43*b* which is configured to prevent the swelling movement of the pressing member 6, and which protrudes toward the connecting beam 44 in the direction to the Z1 side. When the pressing member 6 is pivoted, the central portion of the pressing member 6 in the width direction Y of the housing 1 tends to swell (jut) toward the side opposite to the insertion opening 11 (X2 side). The protrusion 43*b* provided to the pressure receiving beam 43 can reduce this tendency. The size of the protrusion 43*b* is not particularly limited, as long as it can fulfill the role described above. It is suitable to set the size such that the protrusion 43*b* can catch the pressure applying portion 61 of the pressing member 6. Examples (not shown) of the swelling-prevention means include, in addition to the above-described configuration, a groove (recess) for receiving the pressure applying portion 61, a projection (or protrusion) on a side opposite to the protrusion.

The connecting beam 44 is a leg-like portion to be mounted on (connected to) the circuit board (not shown). The connecting beam 44 is disposed in the groove 12 on the lower wall 1*b* (close to the Z1 side) of the housing 1, and faces the pressure receiving beam 43. The connecting beam 44 is closer than the coupling post 45 to the side opposite to the insertion opening 11 (X2 side) of the housing 1. In other words, the connecting beam 44 extends toward the side opposite to the insertion opening 11 (X2 side). The connecting beam 44 has the connecting portion 44*a* to be mounted on (connected to) the circuit board. The connecting portion 44*a* is formed at an end (close to the X2 side) of the connecting beam 44 and on a side (close to the Z1 side) facing away from the pressure receiving beam 43. In the embodiment shown in the drawings, the connecting portion 44*a* is of a surface mount type (SMT). However, the connecting portion 44*a* may be of a dip type or a press fit type.

The coupling post 45 has the coupling portion 45*a* that couples the contact beam 41, the locking beam 42, the pressure receiving beam 43, and the connecting beam 44 to each other. For the sake of convenience, the coupling post 45 is described as a portion coupling the beams 41 to 44 to each other. However, the locking contact 4 is a one-piece component as a whole, and there are no apparent boundaries between the coupling post 45 and the other beams.

Locking Contact 4A of Second Embodiment

Next, a (second) locking contact (second LC) 4A according to a second embodiment will be described with reference to FIG. 6. The second locking contact (second LC) 4A is not provided to the connector 100 shown in FIGS. 1A and 1B. However, the second locking contact (second LC) 4A can be provided to an adoptable housing 1 together with or without the first locking contact (first LC) 4. In the following, a description of parts or configurations having the same or similar functions to those of the first locking contact 4 of the first embodiment is omitted, and parts or configurations different from those of the first locking contact 4 will be mainly described.

As shown in FIG. 6, the second locking contact 4A according to the second embodiment is inserted into the housing 1 from the side with the insertion opening 11 (from the X1 side toward the X2 side). A principal difference between the second locking contact 4A and the first locking contact 4 lies in the second locking contact 4A having a connecting portion 44Aa (a connecting beam (connecting leg portion) 44A) located close to the X1 side, and is provided with an extension beam (extension leg portion) 47. Although the second embodiment includes the extension beam 47, this is a non-limiting example. The extension beam 47 may be excluded from the second embodiment. Alternatively, the extension beam 47 may be shorter than the pressure receiving beam 43 in the insertion/removal direction X.

On the other hand, the positional relationship between the locking portion 42Aa and the contact portion 41Aa is the same as that in the case of the first locking contact 4, the positional relationship constituting one feature of the present invention. Specifically, as shown in FIG. 6, the locking portion 42Aa corresponds in position to the lock-mating portion F1 of the connection target F, and protrudes from a side close to the mounting surface of the circuit board (close to the Z1 side) in a direction away from the mounting surface (the direction toward the Z2 side). The contact portion 41Aa is disposed on the side (close to the Z2 side) which faces the locking portion 42Aa and which is distant from the mounting surface of the circuit board, and is closer than the locking portion 42Aa to the side (X1 side) where the connection target is inserted.

More specifically, the second locking contact 4A includes: the contact portion 41Aa which is configured to contact with one of the two opposite surfaces of the connection target F; the locking portion 42Aa which corresponds in position to the lock-mating portion F1 on the connection target F in the inserted state, and has a shape protruding toward the lock-mating portion F1 in a direction toward the Z2 side; a coupling portion 45Aa which couples the contact portion 41Aa to the locking portion 42Aa; a pressure receiving portion 43Aa which is located on the side (close to the Z2 side) facing the extension beam 47, extends in a direction away from the contact portion 41Aa (toward the X2 side), and is configured to be pressed by the pressing member 6; and a connecting portion 44Aa which extends from the locking portion 42Aa further toward the side with the insertion opening 11 (X1 side), and is configured to be connected to the circuit board.

The second locking contact 4A includes a contact beam (contact leg portion) 41A having the contact portion 41Aa, a locking beam (locking leg portion) 42A having the locking portion 42Aa, a pressure receiving beam (pressure receiving leg portion) 43A having the pressure receiving portion 43Aa, the connecting beam (connecting leg portion) 44A having the connecting portion 44Aa, a coupling post (coupling leg portion) 45A having the coupling portion 45Aa, and the extension beam (extension leg portion) 47 extending toward the X2 side, such that these beams and post are integrated with one another to form an H-shape as a whole. When the extension beam 47 is not provided, the second locking contact 4A includes the other beams and the post integrated with one another to form an h-shape as a whole. In particular, the contact beam 41A, the coupling post 45A, and the connecting beam 44A are arranged in a substantially U-shape.

The extension beam 47 is a leg-shaped portion which is provided on the same side as the locking beam 42A in the Z direction as the height direction of the housing 1, and extends toward the side opposite to the insertion opening (X2 side), the side being provided with the pressing member 6. The extension beam 47 supports, together with the pressure receiving beam 43A, the pressure applying portion 61 of the pressing member 6 when the pressure applying portion makes pivotal motion. Note that the extension beam 47 may be omitted.

[Normal Signal Contacts (NSC)]

[First Signal Contact (NSC1)]

Next, the first signal contact 2 will be described with reference to FIGS. 7A and 7B. The first signal contact 2 includes portions having the same denotation as that of the corresponding portions of the locking contact 4 (irrespective of the presence or absence of, and difference in, an ordinal numeral "nth"; the same applies to the following), and such portions of the first signal contact 2 are the same as the corresponding portions of the locking contact 4 in terms of the configuration and function. Therefore, a description of such portions may be omitted.

As shown in FIGS. 1A to 3B, a predetermined number of first signal contacts 2 are held in the housing 1 while being arranged side-by-side in an array in the Y direction as the lateral direction, and are sandwiched between the pair of first locking contacts 4, 4. The first signal contacts 2 are each press-fitted in, and held by, grooves 14 (also, see FIGS. 12A and 12B). The grooves 14 form part of the group of grooves which are formed on the inner surfaces of the housing 1 facing each other in the Z direction as the height direction and which are partitioned by the walls. The first signal contacts 2 are disposed in the housing 1 by having been inserted from the side opposite to the insertion opening 11 (from the X2 side toward the X1 side).

The first signal contact (NSC1) 2 is a normal signal contact (NSC), i.e., a signal contact not functioning as a lock member. (The same applies to a second signal contact 2A, a third signal contact 3A, and a fourth signal contact 3, which will be described later.)

To be specific, the first signal contact 2 has: a first contact portion (NSC1-1) 21*a* which is configured to contact with at least one of the two opposite surfaces of the connection target F (in the present embodiment, the surface close to the Z2 side); a first connecting portion (NSC1-4) 23*a* which is located closer than the first contact portion 21*a* to the side opposite to the insertion opening 11 (X2 side), and is configured to be mounted on the circuit board; a first coupling portion (NSC1-5) 25*a* which is located between the first contact portion 21*a* and the first connecting portion 23*a*; a first pressure receiving portion (NSC1-3) 22*a* which extends from the first contact portion 21*a* to the side opposite to the insertion opening 11 (X2 side), and is configured to be pressed by the pressing member 6; and a first extension beam (first extension leg portion) 24 extending toward the X1 side.

More specifically, the first signal contact 2 includes a first contact beam (first contact leg portion) 21 having the first contact portion 21*a*, a first pressure receiving beam (first pressure receiving leg portion) 22 having the first pressure receiving portion 22*a*, a first connecting beam (first connecting leg portion) 23 having the first connecting portion 23*a*, a first coupling post (first coupling leg portion) 25 having the first coupling portion 25*a*, and the first extension beam (first extension leg portion) 24, such that these beams and post are integrated with one another to form an H-shape as a whole. When the first extension beam 24 is not provided, the first signal contact 2 includes the other beam and the post integrated with one another to form an h-shape as a whole. In particular, the first contact beam 21 having the first contact portion 21*a*, the first coupling post 25 having the first coupling portion 25*a*, and the first connecting beam 23 having the first connecting portion 23*a* are arranged in a substantial crank shape.

Unlike the locking contact 4, the first signal contact 2 has no locking portion (no locking beam). Instead, the first signal contact 2 is provided with the first extension beam 24 extending to the side with the insertion opening 11 (X1 side), and has an H-shape as a whole. In a state where the connection target F has been inserted into the first signal contact 2, the pressure applying portion 61 of the pressing member 6 is pivotably supported in such a manner that the pressure applying portion 61 can press the first pressure receiving beam 22 having the first pressure receiving portion (NSC1-3) 22*a*.

[Second Signal Contact 2A]

Next, a second signal contact 2A will be described with reference to FIG. 8. The second signal contact (NSC2) 2A is not provided to the connector 100 shown in FIGS. 1A and 1B. However, the second signal contact (NSC2) 2A can be provided to a compatible housing 1. The second signal contact 2A has portions with the same denotation as that of the corresponding portions of the first signal contact 2, and such portions of the second signal contact 2A are the same as the corresponding portions of the first signal contact 2 in terms of configuration and function. Therefore, a description of such portions may be omitted.

A predetermined number of second signal contacts 2A are held in the housing 1 while being arranged side-by-side in an array in the Y direction as the lateral direction. The second signal contacts 2A are press-fitted in, and held by, grooves (not shown) which are formed on the inner surfaces of the housing 1 facing each other in the Z direction as the height direction and which are partitioned by the walls. The second signal contacts 2A are inserted into the housing 1 from the side with the insertion opening 11 (from the X1 side toward the X2 side).

The second signal contact 2A has: a second contact portion (NSC2-1) 21Aa which is configured to contact with at least one of the two opposite surfaces of the connection target F; a second connecting portion (NSC2-4) 23Aa which is located closer than the second contact portion 21Aa to the side with the insertion opening 11 (X1 side), and is configured to be mounted on the circuit board; a second coupling portion (NSC2-5) 25Aa which is located between the second contact portion 21Aa and the second connecting portion 23Aa; a second pressure receiving portion (NSC2-3) 22Aa which is located on a side (close to the Z2 side) facing a second extension beam (second extension leg portion) 27A (to be described later), extends toward the side opposite to the insertion opening 11 (X2 side), and is configured to be pressed by the pressing member 6; and the second extension beam 27A which extends toward the X2 side.

More specifically, the second signal contact 2A includes a second contact beam (second contact leg portion) 21A having the second contact portion 21Aa, a second pressure receiving beam (second pressure receiving leg portion) 22A having the second pressure receiving portion 22Aa, a second connecting beam (second connecting leg portion) 23A having the second connecting portion 23Aa, a second coupling post (second coupling leg portion) having the second coupling portion 25Aa, and the second extension beam (second extension leg portion) 27A, such that these beams and post are integrated with one another to form an H-shape as a whole. When the second extension beam 27A is not provided, the second signal contact 2A includes the other beams and the post integrated with one another to form an h-shape as a whole. In particular, the second contact beam 21A having the second contact portion 21Aa, the second coupling post 25A having the second coupling portion 25Aa, and the second connecting beam 23A having the second connecting portion 23Aa are arranged in a substantial U-shape.

In comparison with the first signal contact 2, the second signal contact 2A has an inverted positional relationship between the connecting portion (connecting beam) and the extension beam in the insertion/removal direction X, while having an H-shape as a whole. In a state where the connection target F has been inserted into the second signal contact 2A, the pressure applying portion 61 of the pressing member 6 is pivotably supported in such a manner that pressure applying portion 61 can press the second pressure receiving beam 22A having the second pressure receiving portion (NSC2-3) 22Aa.

[Third Signal Contact (NSC3)]

Next, a third signal contact 3A will be described with reference to FIG. 9. The third signal contact (NSC3) 3A is not provided to the connector 100 shown in FIGS. 1A and 1B. However, the third signal contact (NSC3) 3A can be provided to a compatible housing 1. The third signal contact 3A has portions with the same denotation as that of the corresponding portions of the first signal contact 2 and the second signal contact 2A, and such portions of the third signal contact 3A is the same as the corresponding portions of the first and second signal contacts 2 and 2A in terms of configuration and function. Therefore, a description of such portions may be omitted.

A predetermined number of third signal contacts 3A are held in the housing 1 while being arranged side-by-side in an array in the Y direction as the lateral direction. The third signal contacts 3A are press-fitted in, and held by, grooves (not shown) which are formed on the inner surfaces of the housing 1 facing each other in the Z direction as the height direction and which are partitioned by the walls. The third signal contacts 3A are inserted into the housing 1 from the side opposite to the insertion opening 11 (from the X2 side toward the X1 side).

The third signal contact 3A has: a third contact portion (NSC3-1) 31Aa which is configured to contact with at least one of the two opposite surfaces of the connection target F; a third connecting portion (NSC3-4) 33Aa which is located closer than the third contact portion 31Aa to the side opposite to the insertion opening 11 (X2 side), and is configured to be mounted on the circuit board; a third coupling portion (NSC3-5) 35Aa which is located between the third contact portion 31Aa and the third connecting portion 33Aa; a third extension beam (third extension leg portion) 34A extending toward the X1 side; and a third counter contact portion 34Aa.

The third counter contact portion 34Aa is provided at a position facing the third contact portion 31Aa in the height direction Z, and is configured to contact with one surface of the connection target F opposite to the other surface to be in contact with the third contact portion 31Aa. The third counter contact portion 34Aa has a shape protruding toward the third contact portion 31Aa in the direction to the Z2 side.

It is suitable that due to the pressure applied by the pressing member 6, the third counter contact portion 34Aa contacts with the connection target F to allow the third contact portion 31Aa to come into stable contact with the connection target F. The third counter contact portion 34Aa may be provided at a position deviated in the insertion/removal direction X, from the location facing the third contact portion 31Aa in the height direction Z of the housing 1.

More specifically, the third signal contact 3A includes a third contact beam (third contact leg portion) 31A having the third contact portion 31Aa, a third connecting beam (third connecting leg portion) 33A having the third connecting portion 33Aa, a third coupling post (third coupling leg portion) 35A having the third coupling portion 35Aa, and the third extension beam (third extension leg portion) 34A, such that these beams and post are integrated with one another to form an h-shape as a whole. In particular, the third contact beam 31A having the third contact portion 31Aa, the third coupling post 35A having the third coupling portion 35Aa, and the third connecting beam 33A having the third connecting portion 33Aa are arranged in a substantial crank shape.

Unlike the first signal contact 2, the third signal contact 3A includes no pressure receiving portion, and accordingly, has an h-shape as a whole. The third signal contact 3A receives the connection target F inserted between the third contact beam 31A and the third extension beam 34A.

[Fourth Signal Contact 3]

Next, the fourth signal contact 3 will be described with reference to FIGS. 10A and 10B. The fourth signal contact 3 has portions with the same denotation as that of the corresponding portions of the first signal contact 2, the second signal contact 2A, and the third signal contact 3A, and such portions of the fourth signal contact 3 are the same as the corresponding portions of the first, second, and third signal contacts 2, 2A, and 3A in terms of configuration and function. Therefore, a description of such portions of the fourth signal contact 3 may be omitted.

As shown in FIGS. 1A to 3B, a predetermined number of fourth signal contacts 3 are held in the housing 1 while being arranged side-by-side in an array in the Y direction as the lateral direction, and are sandwiched between the pair of first locking contacts 4, 4. The fourth signal contacts 3 are each press-fitted in, and held by, grooves 15. The grooves 15 form part of the group of grooves which are formed on the inner surfaces of the housing 1 facing each other in the Z direction as the height direction and which are partitioned by the walls. The fourth signal contacts 3 are disposed in the housing 1 by having been inserted from the side with the insertion opening 11 (from the X1 side toward the X2 side).

The fourth signal contact 3 has: a fourth contact portion (NSC4-1) 31*a* which is configured to contact with at least one of the two opposite surfaces of the connection target F (in the present embodiment, the surface close to the Z2 side); a fourth connecting portion (NSC4-4) 33*a* which is located closer than the fourth contact portion 31*a* to the side with the insertion opening 11 (X1 side), and is configured to be mounted on the circuit board; a fourth coupling portion (NSC4-5) 35*a* which is located between the fourth contact portion 31*a* and the fourth connecting portion 33*a*; a fourth counter contact portion 34*a*; and a fourth extension beam (fourth extension leg portion) 37 extending toward the X2 side.

More specifically, the fourth signal contact 3 includes a fourth contact beam (fourth contact leg portion) 31 having the fourth contact portion 31*a*, a fourth connecting beam (fourth connecting leg portion) 33 having the fourth connecting portion 33*a*, a fourth coupling post (fourth coupling leg portion) 35 having the fourth coupling portion 35*a*, and the fourth extension beam (fourth extension leg portion) 37, such that these beams and post are integrated with one another to form an h-shape as a whole. In particular, the fourth contact beam 31 having the fourth contact portion 31*a*, the fourth coupling post 35 having the fourth coupling portion 35*a*, and the fourth connecting beam 33 having the fourth connecting portion 33*a* are arranged in a substantial U-shape. The fourth counter contact portion 34*a* is located between the fourth connecting portion 33*a* and the fourth coupling portion 35*a* in the insertion/removal direction X.

In comparison with the third signal contact 3A, the fourth signal contact 3 has an inverted positional relationship between the connecting portion (connecting beam) and the extension beam in the insertion/removal direction X, while having an h-shape as a whole. The fourth signal contact 3 receives the connection target F inserted between the fourth contact beam 31 and the fourth connecting beam 33.

[Retaining Bracket 7]

The retaining bracket 7 will be described with reference to FIGS. 11A and 11B. As shown in FIGS. 1A to 3B, the retaining brackets 7 are provided closer than the locking contacts 4 to the respective Y+ sides. The retaining brackets 7 are held in the housing 1, separately from the contacts. To be specific, as shown in FIGS. 11A and 11B, the retaining bracket 7 has: a base 72 which extends in the X direction, a first projection 73 which is provided on a side of the base 72 close to the X1 side and projects toward the Z1 side; a second projection 74 which is located closer than the first projection 73 to the X2 side, and projects toward the Z1 side; a third projection 75 which is located closer than the second projection 74 to the X2 side, and projects toward the Z1 side; and the movement-restricting portion 71 formed as a recess depressed from the base 72, the second projection 74 and the third projection 75 in the direction to the Z2 side. The third projection 75 has an end substantially extending toward the X2 side.

The first projection 73 and the second projection 74 sandwich a portion of the housing 1 therebetween in the insertion/removal direction X, whereby the retaining bracket 7 is fastened to the housing 1. The first projection 73 and the third projection 75 are mechanically connected to the circuit board at their ends close to the Z1 side. The movement-restricting portion 71 has an opening which faces the Z1 side and is adjacent to the lower wall 1*b* of the housing 1. The inner peripheral edge of the movement-restricting portion 71 and the upper edge of the lower wall 1*b* define a hole, in which a pivot shaft (boss) 62 of the pressing member 6 is disposed. The pivot shaft 62 of the pressing member 6 is disposed such that a range of movement is restricted by means of this hole, whereby the pressing member 6 can pivot within a restricted range of movement.

[Housing]

Next, the configuration of the housing 1 will be specifically described with reference to FIGS. 12A and 123. The housing 1 has the upper wall 1*a* and the lower wall 1*b* which face each other in the Z direction as the height direction of the housing 1, and a pair of (two) side walls 1*c* which extend in the Y direction as the lateral direction and connect the upper wall 1*a* to the lower wall 1*b*. The insertion opening 11 of the housing 1 is defined by the upper wall 1*a*, the lower wall 1*b*, and the two side walls 1*c*.

The housing 1 has the plurality of grooves each holding an associated one of the first signal contacts 2, the fourth signal contacts 3, the locking contacts 4, and the retaining brackets 7. The grooves are formed at positions on the inner surface of the upper wall 1*a* and the inner surface of the lower wall 1*b*, the positions facing each other in the height direction Z of the housing 1. The grooves include the grooves 12 holding the locking contacts 4, the grooves 14 holding the first signal contacts 2, the grooves 15 holding the fourth signal contacts 3, and grooves 16 holding the retaining brackets 7.

FIGS. 12A and 12B show the housing 1 in the case where the grooves 12, 14, 15 are formed to pass through the housing 1 in the direction in which the contacts 2, 3, 4 extend (in the X direction). The signal contacts 2, 3, 4 and the retaining brackets 7 are each fixed to the inside of the associated one of the grooves 14, 15, 12, 16 by, for example, press fitting, catching (lance), or welding.

The upper wall 1*a* of the housing 1 has a cut-off portion 17. When the pressing member 6 transitions from the second pressing member position OP to the first pressing member position CP to press the first signal contacts 2 and the locking contacts 4, the cut-off portion 17 lets the pressure receiving beams 22, 43 of the contacts 2, 4 to be displaced upward. Further, the cut-off portion 17 makes it possible to reduce the height of the connector 100. The size of the cut-off portion 17 is appropriately designed in consideration of the role described above, the reduction in the height of the connector 100, formability, strength, etc.

[Pressing Member]

Next, the pressing member 6 will be described with reference to FIGS. 13A and 13B. The pressing member 6 according to the present embodiment is pivotable between the first pressing member position CP for applying pressure to press the pressure receiving portions 43*a* of the locking contacts 4 and the first pressure receiving portions 22*a* of the first signal contacts 2, and the second pressing member position OP for releasing the pressure receiving portions from the pressure. In the second pressing member position OP, the connection target F is allowed to be inserted into and removed from the housing 1. In the first pressing member position CP, the first signal contacts 2 and the locking contacts 4 are stably maintained in pressing contact with the connection target F. In the present embodiment, the pressing member 6 has: the pressure applying portion 61 which presses the pressure receiving portions 43*a* of the locking contacts 4 or/and the first pressure receiving portions 22*a* of the first signal contacts 2 when the pressing member 6 is in the first pressing member position CP, and which extends in the array direction Y in which that signal contacts 2, 3, 4 configured to be pressed are arranged side-by-side; a counter wall 64 which faces the pressure applying portion 61 and extends in the array direction Y; connecting walls 65 which connect the pressure applying portion 61 and the counter wall 64 that extend independently to each other, and which are arranged with intervals interposed therebetween in the array direction Y; a predetermined number of independent through holes 63 through which the pressure receiving portions 43*a* of the locking contacts 4 or/and the first pressure receiving portions 22*a* of the first signal contacts 2 pass at least when the pressing member 6 is in the second pressing member position OP; and the pivot shaft 62 which is rotatably fitted in the movement-restricting portion 71. The through holes 63 are defined by the pressure applying portion 61, the counter wall 64, and the connecting walls 65.

The pressing member 6 is pivotable between the first pressing member position CP in which the pressing member 6 applies pressure to press the pressure receiving portions 43*a* of the locking contacts 4 or/and the first pressure receiving portions 22*a* of the first signal contacts 2, and the second pressing member position OP in which the pressing member 6 releases the pressure receiving portions 43*a* of the locking contacts 4 or/and the first pressure receiving portions 22*a* of the first signal contacts 2 from the pressure. The pressing in the first pressing member position CP and the release of the pressure in the second pressing member position OP are not distinguished from each other simply by the presence or absence of the contact between the pressing member 6 and the pressure receiving portions. The pressing in the first pressing member position CP refers to an application of pressure enabling the pressing contact to be stably maintained. If the pressing contact is not stably maintained, the pressure can be regarded to be released even though the pressing member 6 is in contact with the pressure receiving portions.

In the first pressing member position CP, the pressing member 6 moves, by means of the pressure applying portion 61 extending in the array direction Y, the pressure receiving portions 43*a* of the locking contacts 4 or/and the first pressure receiving beams 22 of the first signal contacts 2 in the direction away from the mounting surface of the circuit board (toward the Z2 side), and the pressure applying portion 61 is positioned to apply pressure to the pressure receiving portions 43*a* of the locking contacts 4. Note that the connector of the present invention may include contacts configured not to be pressed by the pressure applying portion 61 (i.e., a portion having a shape capable of pressing the contacts) of the pressing member 6, unlike the present embodiment. In other words, the connector of the present invention may include contacts having no pressure receiving portions.

In the second pressing member position OP, the through holes 63 receive the pressure receiving portions 43*a* of the locking contacts 4 or/and the first pressure receiving portions 22*a* of the first signal contacts 2 passing therethrough.

The extending pressure applying portion 61 is a portion which presses the first pressure receiving beams 22 of the first signal contacts 2 or/and the pressure receiving beam 43 of the locking contacts 4, and which pushes them upward in the direction away from the mounting surface of the circuit board. At least a part of the pressure applying portion 61 which is to contact with the first signal contacts 2, the locking contacts 4, or the lower wall 1*b* of the housing 1 may have any shape, as long as the part can push the beams upward as described above. The pressure applying portion 61 may have an arc portion as a part thereof. In this case, the arc portion is preferably formed to correspond to the pivoting range of the pressing member 6 between the second pressing member position OP and the first pressing member position CP. The pressure applying portion 61 may have an elongated shape having a longitudinal direction, or an elliptical shape having major and minor axes. That is, it is suitable for the extending pressure applying portion 61 has a shape with different lengths in different directions, and can push the beams upward in the manner described above.

The pivot shaft 62 is fitted in the movement-restricting portion 71 and is configured to cause the pressing member 6 to smoothly pivot between the second pressing member position OP and the first pressing member position CP. If the pressure applying portion 61 is supported on the first signal contacts 2 and the locking contacts 4 and the pressing member 6 can pivot without any trouble, the pivot shaft 62 may be omitted.

The through holes 63 function as relief to impart sufficient elasticity (spring properties) to the first pressure receiving beams 22 of the first signal contacts 2 and the pressure receiving beams 43 of the locking contacts 4, while avoiding an increase in the dimension of the connector in the X1-X2 direction. The through holes 63 are separated individually from each other by being partitioned by the connecting walls 65. Providing the through holes 63 as individual holes makes it possible to increase the pressing member 6 in stiffness and to prevent deformation of the pressing member 6 when the pressing member 6 pivots.

[Motion of Locking Contact]

Next, it will be described how the locking contact 4 configured as described above moves when being pressed by the pressing member 6, with reference to FIGS. 4A and 4B. For ease of visibility, the connection target F is omitted from FIGS. 4A and 4B.

When the pressing member 6 is in the second pressing member position OP, the connection target F can be inserted between the contact beam 41 and the locking beam 42 of the locking contact 4. Simply inserting the connection target F can bring the contact portion 41*a* of the contact beam 41 into electrical contact with the land F2 of the connection target F. As shown in FIG. 4A, when the pressing member 6 is in the second pressing member position OP, the contact portion 41*a* of the contact beam 41 can be brought into electrical contact with the connection target F, but the connection in this state is not stable.

The pressing member 6 is pivoted to be brought into the first pressing member position CP shown in FIG. 4B, whereby the electrical connection between the locking contact 4 and the connection target F is stabilized and the connection target F enters a state where the removal thereof is reliably prevented. Specifically, when the pressing member 6 moves from the second pressing member position OP to the first pressing member position CP, the pressure receiving beam 43 of the locking contact 4 is pushed upward (toward the Z2 side) by the pressure applying portion 61 of the pressing member 6 so as to be displaced obliquely. As a result of this upward displacement of the pressure receiving beam 43, the contact beam 41 is displaced obliquely downward (toward the Z1 side). This downward displacement of the contact beam 41 causes the contact portion 41*a* of the contact beam 41 and the locking beam 42 to sandwich and fasten the connection target F such that the contact portion 41*a* comes into pressing contact with the land F2 of one surface of the connection target F, thereby achieving electrically stable contact.

The downward displacement of the contact beam 41 brings the contact portion 41*a* thereof into pressing contact with the connection target F. Since the contact portion 41*a* of the contact beam 41 presses the connection target F downward, the locking portion 42*a* of the locking beam 42 reliably locks the connection target F at the lock-mating portion F1 thereof, thereby ensuring prevention of removal of the connection target F. In this way, further stable electrical contact is achieved between the contact portion 41*a* of the contact beam 41 and the connection target F.

Effects of Embodiment

The connector 100 of the present embodiment includes the contact portion 41*a*, the locking portion 42*a*, the connecting portion 44*a*, and the pressure receiving portion 43*a* that are made of the same metal material and integrated with each other. The lock member includes at least one locking contact 4 usable in a conductive manner. The locking portion 42*a* corresponding in position to the lock-mating portion F1 of the connection target F, is provided on a side (close to the Z1 side) adjacent to the mounting surface of the circuit board, and protrudes in a direction away from the mounting surface of the circuit board (toward the Z2 side). The contact portion 41*a* is provided on a side (close to the Z2 side) which faces the locking portion 42*a* and is distant from the mounting surface of the circuit board, and is closer than the locking portion 42*a* to the side (X1 side) where the connection target F is inserted.

Thus, the connector 100 of the embodiment causes the locking portion 42*a* to engage with the lock-mating portion F1, and thereby enables an increase in the holding force exerted on the connection target F. Since the lock member is used as a signal contact, the number of the signal contacts can be reduced. As a result, the dimension of the array of the contacts 2, 3, 4 can be reduced in the array direction Y (the pitches can be narrowed), enabling more signal contacts 2, 3, 4 to be arranged. The configuration in which the contact portion 41*a* is closer than the locking portion 42*a* to the side (X1 side) where the connection target F is inserted allows facilitation of the pattern formation of the connection target F.

[Modifications]

In the foregoing, some embodiments of the present invention have been described. However, the present invention is not limited to the embodiments described above, and appropriate modifications can be made to the present invention. One or more locking contacts 4 (lock members) may be provided at inner positions (near the center) in the lateral direction Y. This configuration can enhance the locking function (the holding force). The first locking contact 4 may have an extension beam which is provide closer than the locking portion 42*a* to the X1 side. The contact of each type may exclude the extension beam which is closer than the pressure receiving beam to the Z1 side.

As the normal signal contacts, signal contacts of one or more types selected from the first signal contact 2, the second signal contact 2A, the third signal contact 3A, and the fourth signal contact 3 can be provided. Among them, the first signal contacts 2 and the second signal contacts 2A or the fourth signal contacts 3 preferably alternate with each other in a staggered arrangement. Likewise, the third signal contacts 3A and the second signal contacts 2A or the fourth signal contacts 3 preferably alternate with each other in a staggered arrangement. This is because the connection portions can be arranged efficiently to increase mounting efficiency. In a case where signal contacts of the same type are arranged in one array, from the viewpoint of increase in connection strength, the connecting portions of the lock members and the connecting portions of the normal signal contacts are arranged opposite to each other in the insertion/removal direction. The contacts (including the locking contacts) are not limited to the signal contacts, but may be power source contacts. Not all the lock members need to be the locking contacts. Part of the lock members may be a non-contact member (a member dedicated to locking). The portions in which the contacts or the like are placed is not limited to the grooves (in the embodiment, the grooves 12, the grooves 14, the grooves 15, and the grooves 16), but may be formed as, for example, holes or openings, as long as they can receive the contacts or the like placed therein.

EXPLANATION OF REFERENCE NUMERALS

1: Housing
2: First Signal Contact (First Contact)
2A: Second Signal Contact (Second Contact)
3: Fourth Signal Contact (Fourth Contact)
3A: Third Signal Contact (Third Contact)
4: (First) Locking Contact (Lock Member)
4A: (Second) Locking Contact (Lock Member)
6: Pressing Member
7: Retaining Bracket
11: Insertion Opening
12, 14, 15, 16: Groove
21: First Contact Beam
21*a*: First Contact Portion
21A: Second Contact Beam
21Aa: Second Contact Portion
22: First Pressure Receiving Beam
22*a*: First Pressure Receiving Portion
22A: Second Pressure Receiving Beam
22Aa: Second Pressure Receiving Portion
23: First Connecting Beam
23*a*: First Connecting Portion
23A: Second Connecting Beam
23Aa: Second Connecting Portion
24: First Extension Beam
25: First Coupling Post
25*a*: First Coupling Portion
25A: Second Coupling Post
25Aa: Second Coupling Portion
27A: Second Extension Beam
31: Fourth Contact Beam
31*a*: Fourth Contact Portion
31A: Third Contact Beam
31Aa: Third Contact Portion
33: Fourth Connecting Beam
33*a*: Fourth Connecting Portion
33A: Third Connecting Beam
33Aa: Third Connecting Portion
34*a*: Fourth Counter Contact Portion
34A: Third Extension Beam
34Aa: Third Counter Contact Portion
35: Fourth Coupling Post

35*a*: Fourth Coupling Portion
35A: Third Coupling Post
35Aa: Third Coupling Portion
37: Fourth Extension Beam
41: Contact Beam
41*a*: Contact Portion
41A: Contact Beam
41Aa: Contact Portion
42: Locking Beam
42*a*: Locking Portion
42A: Locking Beam
42Aa: Locking Portion
43: Pressure Receiving Beam
43*a*: Pressure Receiving Portion
43A: Pressure Receiving Beam
43Aa: Pressure Receiving Portion
43*b*: Protrusion
44: Connecting Beam
44*a*: Connecting Portion
44A: Connecting Beam
44Aa: Connecting Portion
45: Coupling Post
45*a*: Coupling Portion
45A: Coupling Post
45Aa: Coupling Portion
47: Extension Beam
61: Pressure Applying Portion
62: Pivot Shaft
63: Through Hole
64: Counter Wall
65: Connecting Wall
71: Movement-Restricting Portion
72: Base
73: First Flat Projection
74: Second Flat Projection
75: Third Flat Projection
100: Connector
CP: First Pressing Member Position
F: Connection Target
F1: Lock-Mating Portion
F2: Land
OP: Second Pressing Member Position
X: Insertion/Removal Direction
Y: Array Direction
Z: Height Direction

The invention claimed is:

1. A connector for connection with a connection target through removable insertion of the connection target therein, the connector being mountable on a circuit board and comprising:

a housing having an insertion opening through which the connection target is inserted to become substantially parallel to a mounting surface of the circuit board in an inserted state;

a predetermined number of contacts (C) held in the housing while being arranged side-by-side in an array, the contact (C) having a contact portion configured to contact with the connection target and a connecting portion configured to be mounted on the circuit board;

a lock member held in the housing and configured to engage with the connection target; and a pressing member provided on a side of the housing opposite to the insertion opening, and having a portion shaped to be capable of pressing at least the lock member, wherein the lock member has a contact portion (LC1) which is configured to contact with one of two opposite surfaces of the connection target, a locking portion (LC2) which has a shape engageable with a lock-mating portion formed on the connection target inserted in a proper insertion position with respect to the connector, a connecting portion (LC4) which is located closer than the locking portion (LC2) to a side with the insertion opening or the side opposite to the insertion opening, and is configured to be mounted on the circuit board, and a pressure receiving portion (LC3) which extends from the contact portion (LC1) toward the side opposite to the insertion opening and is configured to be pressed by the pressing member, wherein the contact portion (LC1), the locking portion (LC2), the connecting portion (LC4), and the pressure receiving portion (LC3) are made of an identical metal material and integrated with one another, wherein the connector includes at least one locking contact (LC) as the lock member usable in a conductive manner, wherein the locking portion (LC2) corresponds in position to the lock-mating portion of the connection target, is located on a side close to the mounting surface of the circuit board, and protrudes in a direction away from the mounting surface of the circuit board, and wherein the contact portion (LC1) is provided on a side facing the locking portion (LC2) and being distant from the mounting surface of the circuit board, and is located closer than the locking portion (LC2) to the side where the connection target is inserted.

2. The connector according to claim 1, wherein the locking contact (LC) further has a coupling portion (LC5) located between the contact portion (LC1) and the connecting portion (LC4), and wherein a contact beam having the contact portion (LC1), a coupling post having the coupling portion (LC5), and a connecting beam having the connecting portion (LC4) are arranged in a substantial crank shape or a substantial U-shape.

3. The connector according to claim 1, wherein the contacts (C) include a first contact (NSC1) having: a first contact portion (NSC1-1) which is configured to contact with at least one of the two opposite surfaces of the connection target; a first connecting portion (NSC1-4) which is located closer than the first contact portion (NSC1-1) to the side opposite to the insertion opening, and is configured to be mounted on the circuit board; a first coupling portion (NSC1-5) which is located between the first contact portion (NSC1-1) and the first connecting portion (NSC1-4); and a first pressure receiving portion (NSC1-3) which extends from the first contact portion (NSC1-1) toward the side opposite to the insertion opening, and is configured to be pressed by the pressing member, and wherein a first contact beam having the first contact portion (NSC1-1), a first coupling post having the first coupling portion (NSC1-5), and a first connecting beam having the first connecting portion (NSC1-4) are arranged in a substantial crank shape.

4. The connector according to claim 1, wherein the contacts (C) include a second contact (NSC2) having: a second contact portion (NSC2-1) which is configured to contact with at least one of the two opposite surfaces of the connection target; a second connecting portion (NSC2-4) which is located closer than the second contact portion (NSC2-1) to the side with the insertion opening, and is configured to be mounted on the circuit board; a second coupling portion (NSC2-5) which is located between the second contact portion (NSC2-1) and the second connecting portion (NSC2-4); and a second pressure receiving portion (NSC2-3) which extends from the second contact portion (NSC2-1) toward a side opposite to the insertion opening, and is configured to be pressed by the pressing member, and wherein a second contact beam having the second contact portion (NSC2-1), a second coupling post having the second coupling portion (NSC2-5), and a second connecting beam having the second connecting portion (NSC2-4) are arranged in a substantial U-shape.

5. The connector according to claim 1, wherein the contacts (C) include a third contact (NSC3) having: a third contact portion (NSC3-1) which is configured to contact with at least one of the two opposite surfaces of the connection target; a third connecting portion (NSC3-4) which is located closer than the third contact portion (NSC3-1) to the side opposite to the insertion opening, and is configured to be mounted on the circuit board; and a third coupling portion (NSC3-5) which is located between the third contact portion (NSC3-1) and the third connecting portion (NSC3-4), and wherein a third contact beam having the third contact portion (NSC3-1), a third coupling post having the third coupling portion (NSC3-5), and a third connecting beam having the third connecting portion (NSC3-4) are arranged in a substantial crank shape.

6. The connector according to claim 1, wherein the contacts (C) include a fourth contact (NSC4) having: a fourth contact portion (NSC4-1) which is configured to contact with at least one of the two opposite surfaces of the connection target; a fourth connecting portion (NSC4-4) which is located closer than the fourth contact portion (NSC4-1) to the side with the insertion opening, and is configured to be mounted on the circuit board; and a fourth coupling portion (NSC4-5) which is located between the fourth contact portion (NSC4-1) and the fourth connecting portion (NSC4-4), and wherein a fourth contact beam having the fourth contact portion (NSC4-1), a fourth coupling post having the fourth coupling portion (NSC4-5), and a fourth connecting beam having the fourth connecting portion (NSC4-4) are arranged in a substantial U-shape.

7. The connector according to claim 2, wherein the contacts (C) include a first contact (NSC1) having: a first contact portion (NSC1-1) which is configured to contact with at least one of the two opposite surfaces of the connection target; a first connecting portion (NSC1-4) which is located closer than the first contact portion (NSC1-1) to the side opposite to the insertion opening, and is configured to be mounted on the circuit board; a first coupling portion (NSC1-5) which is located between the first contact portion (NSC1-1) and the first connecting portion (NSC1-4); and a first pressure receiving portion (NSC1-3) which extends from the first contact portion (NSC1-1) toward the side opposite to the insertion opening, and is configured to be pressed by the pressing member, and wherein a first contact beam having the first contact portion (NSC1-1), a first coupling post having the first coupling portion (NSC1-5), and a first connecting beam having the first connecting portion (NSC1-4) are arranged in a substantial crank shape.

8. The connector according to claim 2, wherein the contacts (C) include a second contact (NSC2) having: a second contact portion (NSC2-1) which is configured to contact with at least one of the two opposite surfaces of the connection target; a second connecting portion (NSC2-4) which is located closer than the second contact portion (NSC2-1) to the side with the insertion opening, and is configured to be mounted on the circuit board; a second coupling portion (NSC2-5) which is located between the second contact portion (NSC2-1) and the second connecting portion (NSC2-4); and a second pressure receiving portion (NSC2-3) which extends from the second contact portion (NSC2-1) toward a side opposite to the insertion opening, and is configured to be pressed by the pressing member, and wherein a second contact beam having the second contact portion (NSC2-1), a second coupling post having the second coupling portion (NSC2-5), and a second connecting beam having the second connecting portion (NSC2-4) are arranged in a substantial U-shape.

9. The connector according to claim 2, wherein the contacts (C) include a third contact (NSC3) having: a third contact portion (NSC3-1) which is configured to contact with at least one of the two opposite surfaces of the connection target; a third connecting portion (NSC3-4) which is located closer than the third contact portion (NSC3-1) to the side opposite to the insertion opening, and is configured to be mounted on the circuit board; and a third coupling portion (NSC3-5) which is located between the third contact portion (NSC3-1) and the third connecting portion (NSC3-4), and wherein a third contact beam having the third contact portion (NSC3-1), a third coupling post having the third coupling portion (NSC3-5), and a third connecting beam having the third connecting portion (NSC3-4) are arranged in a substantial crank shape.

10. The connector according to claim 2, wherein the contacts (C) include a fourth contact (NSC4) having: a fourth contact portion (NSC4-1) which is configured to contact with at least one of the two opposite surfaces of the connection target; a fourth connecting portion (NSC4-4) which is located closer than the fourth contact portion (NSC4-1) to the side with the insertion opening, and is configured to be mounted on the circuit board; and a fourth coupling portion (NSC4-5) which is located between the fourth contact portion (NSC4-1) and the fourth connecting portion (NSC4-4), and wherein a fourth contact beam having the fourth contact portion (NSC4-1), a fourth coupling post having the fourth coupling portion (NSC4-5), and a fourth connecting beam having the fourth connecting portion (NSC4-4) are arranged in a substantial U-shape.

11. The connector according to claim 1, wherein the pressing member is pivotable between a first pressing member position for applying pressure to press the pressure receiving portion, and a second pressing member position for releasing the pressure receiving portion from the pressure, wherein the pressing member has a pressure applying portion which extends in an array direction in which the contacts (C) are arranged side-by-side; a counter wall which faces the pressure applying portion and extends in the array direction; connecting walls which connect the pressure applying portion and the counter wall to each other, and which are arranged with intervals interposed therebetween in the array direction; and through holes which are defined by the pressure applying portion, the counter wall, and the connecting walls, wherein in the first pressing member position, the pressing member moves, by means of the pressure applying portion extending in the array direction, the pressure receiving portion in a direction away from the mounting surface of the circuit board, and at least in the second pressing member position, the pressure receiving portion passes through the through hole.

12. The connector according to claim 2, wherein the pressing member is pivotable between a first pressing member position for applying pressure to press the pressure receiving portion, and a second pressing member position for releasing the pressure receiving portion from the pressure, wherein the pressing member has a pressure applying portion which extends in an array direction in which the contacts (C) are arranged side-by-side; a counter wall which faces the pressure applying portion and extends in the array direction; connecting walls which connect the pressure applying portion and the counter wall to each other, and which are arranged with intervals interposed therebetween in the array direction; and through holes which are defined by the pressure applying portion, the counter wall, and the connecting walls, wherein in the first pressing member position, the pressing member moves, by means of the pressure applying portion extending in the array direction, the pressure receiving portion in a direction away from the mounting surface of the circuit board, and at least in the second pressing member position, the pressure receiving portion passes through the through hole.

13. The connector according to claim 3, wherein the pressing member is pivotable between a first pressing member position for applying pressure to press the pressure receiving portion or the first pressure receiving portion, and a second pressing member position for releasing the pressure receiving portion or the first pressure receiving portion from the pressure, wherein the pressing member has a pressure applying portion which extends in an array direction in which the contacts (C) are arranged side-by-side; a counter wall which faces the pressure applying portion and extends in the array direction; connecting walls which connect the pressure applying portion and the counter wall to each other, and which are arranged with intervals interposed therebetween in the array direction; and through holes which are defined by the pressure applying portion, the counter wall, and the connecting walls, wherein in the first pressing member position, the pressing member moves, by means of the pressure applying portion extending in the array direction, the pressure receiving portion or the first pressure receiving portion in a direction away from the mounting surface of the circuit board, and at least in the second pressing member position, the pressure receiving portion or the first pressure receiving portion passes through the through hole.

14. The connector according to claim 4, wherein the pressing member is pivotable between a first pressing member position for applying pressure to press the pressure receiving portion or the second pressure receiving portion, and a second pressing member position for releasing the pressure receiving portion or the second pressure receiving portion from the pressure, wherein the pressing member has a pressure applying portion which extends in an array direction in which the contacts (C) are arranged side-by-side; a counter wall which faces the pressure applying portion and extends in the array direction; connecting walls which connect the pressure applying portion and the counter wall to each other, and which are arranged with intervals interposed therebetween in the array direction; and through holes which are defined by the pressure applying portion, the counter wall, and the connecting walls, wherein in the first pressing member position, the pressing member moves, by means of the pressure applying portion extending in the array direction, the pressure receiving portion or the second pressure receiving portion in a direction away from the mounting surface of the circuit board, and at least in the second pressing member position, the pressure receiving portion or the second pressure receiving portion passes through the through hole.

15. The connector according to claim 5, wherein the pressing member is pivotable between a first pressing member position for applying pressure to press the pressure receiving portion, and a second pressing member position for releasing the pressure receiving portion from the pressure, wherein the pressing member has a pressure applying portion which extends in an array direction in which the contacts (C) are arranged side-by-side; a counter wall which faces the pressure applying portion and extends in the array direction; connecting walls which connect the pressure applying portion and the counter wall to each other, and which are arranged with intervals interposed therebetween in the array direction; and through holes which are defined by the pressure applying portion, the counter wall, and the connecting walls, wherein in the first pressing member position, the pressing member moves, by means of the pressure applying portion extending in the array direction, the pressure receiving portion in a direction away from the mounting surface of the circuit board, and at least in the second pressing member position, the pressure receiving portion passes through the through hole.

16. The connector according to claim 6, wherein the pressing member is pivotable between a first pressing member position for applying pressure to press the pressure receiving portion and a second pressing member position for releasing the pressure receiving portion from the pressure, wherein the pressing member has a pressure applying portion which extends in an array direction in which the contacts (C) are arranged side-by-side; a counter wall which faces the pressure applying portion and extends in the array direction; connecting walls which connect the pressure applying portion and the counter wall to each other, and which are arranged with intervals interposed therebetween in the array direction; and through holes which are defined by the pressure applying portion, the counter wall, and the connecting walls, wherein in the first pressing member position, the pressing member moves, by means of the pressure applying portion extending in the array direction, the pressure receiving portion in a direction away from the mounting surface of the circuit board, and at least in the second pressing member position, the pressure receiving portion passes through the through hole.

17. The connector according to claim 7, wherein the pressing member is pivotable between a first pressing member position for applying pressure to press the pressure receiving portion or the first pressure receiving portion, and a second pressing member position for releasing the pressure receiving portion or the first pressure receiving portion from the pressure, wherein the pressing member has a pressure applying portion which extends in an array direction in which the contacts (C) are arranged side-by-side; a counter wall which faces the pressure applying portion and extends in the array direction; connecting walls which connect the pressure applying portion and the counter wall to each other, and which are arranged with intervals interposed therebetween in the array direction; and through holes which are defined by the pressure applying portion, the counter wall, and the connecting walls, wherein in the first pressing member position, the pressing member moves, by means of the pressure applying portion extending in the array direction, the pressure receiving portion or the first pressure receiving portion in a direction away from the mounting surface of the circuit board, and at least in the second pressing member position, the pressure receiving portion or the first pressure receiving portion passes through the through hole.

18. The connector according to claim 8, wherein the pressing member is pivotable between a first pressing member position for applying pressure to press the pressure receiving portion or the second pressure receiving portion, and a second pressing member position for releasing the pressure receiving portion or the second pressure receiving portion from the pressure, wherein the pressing member has a pressure applying portion which extends in an array direction in which the contacts (C) are arranged side-by-side; a counter wall which faces the pressure applying portion and extends in the array direction; connecting walls which connect the pressure applying portion and the counter wall to each other, and which are arranged with intervals interposed therebetween in the array direction; and through holes which are defined by the pressure applying portion, the counter wall, and the connecting walls, wherein in the first pressing member position, the pressing member moves, by means of the pressure applying portion extending in the array direction, the pressure receiving portion or the second pressure receiving portion in a direction away from the mounting surface of the circuit board, and at least in the second pressing member position, the pressure receiving portion or the second pressure receiving portion passes through the through hole.

19. The connector according to claim 9, wherein the pressing member is pivotable between a first pressing member position for applying pressure to press the pressure receiving portion, and a second pressing member position for releasing the pressure receiving portion from the pressure, wherein the pressing member has a pressure applying portion which extends in an array direction in which the contacts (C) are arranged side-by-side; a counter wall which faces the pressure applying portion and extends in the array direction; connecting walls which connect the pressure applying portion and the counter wall to each other, and which are arranged with intervals interposed therebetween in the array direction; and through holes which are defined by the pressure applying portion, the counter wall, and the connecting walls, wherein in the first pressing member position, the pressing member moves, by means of the pressure applying portion extending in the array direction, the pressure receiving portion in a direction away from the mounting surface of the circuit board, and at least in the second pressing member position, the pressure receiving portion passes through the through hole.

20. The connector according to claim 10 wherein the pressing member is pivotable between a first pressing member position for applying pressure to press the pressure receiving portion, and a second pressing member position for releasing the pressure receiving portion from the pressure, wherein the pressing member has a pressure applying portion which extends in an array direction in which the contacts (C) are arranged side-by-side; a counter wall which faces the pressure applying portion and extends in the array direction; connecting walls which connect the pressure applying portion and the counter wall to each other, and which are arranged with intervals interposed therebetween in the array direction; and through holes which are defined by the pressure applying portion, the counter wall, and the connecting walls, wherein in the first pressing member position, the pressing member moves, by means of the pressure applying portion extending in the array direction, the pressure receiving portion in a direction away from the mounting surface of the circuit board, and at least in the second pressing member position, the pressure receiving portion passes through the through hole.

* * * * *